US007180495B1

(12) United States Patent
Matsueda

(10) Patent No.: US 7,180,495 B1
(45) Date of Patent: Feb. 20, 2007

(54) DISPLAY DEVICE HAVING A DISPLAY DRIVE SECTION

(75) Inventor: Yojiro Matsueda, Chino (JP)

(73) Assignee: Seiko Epson Corporation, Tokyo (JP)

( * ) Notice: Subject to any disclaimer, the term of this patent is extended or adjusted under 35 U.S.C. 154(b) by 325 days.

(21) Appl. No.: 09/868,322

(22) PCT Filed: Oct. 16, 2000

(86) PCT No.: PCT/JP00/07175

§ 371 (c)(1),
(2), (4) Date: Jun. 18, 2001

(87) PCT Pub. No.: WO01/29814

PCT Pub. Date: Apr. 26, 2001

(30) Foreign Application Priority Data

Oct. 18, 1999 (JP) ..... 11-294996

(51) Int. Cl.
*G09G 5/00* (2006.01)

(52) U.S. Cl. ..... 345/98; 345/87; 345/89; 345/92; 345/100; 345/204; 345/205; 345/206

(58) Field of Classification Search ..... 345/87, 345/89, 95, 98, 99, 100, 211, 213, 204–206, 345/92

See application file for complete search history.

(56) References Cited

U.S. PATENT DOCUMENTS 5,361,343 A * 11/1994 Kosonocky et al. ... 365/185.11
5,440,718 A * 8/1995 Kumagai et al. ..... 711/154
5,761,694 A * 6/1998 Rao ..... 711/5

(Continued)

FOREIGN PATENT DOCUMENTS

EP 0286309 A2 10/1988

(Continued)

OTHER PUBLICATIONS

R. Abbott et al., "Equipping a Line of Memories With Spare Cells," Electronics, VNU Business Publications, vol. 54, No. 15, pp. 127-130, Jul. 1981.

*Primary Examiner*—Richard Hjerpe
*Assistant Examiner*—Jennifer T. Nguyen
(74) *Attorney, Agent, or Firm*—Oliff & Berridge, PLC

(57) ABSTRACT

The invention provides a display device having, integrated on a substrate and integrally formed therewith, an active-matrix LCD section having a plurality of scanning lines and a plurality of data lines formed in a grating form corresponding to dots, and active elements according to the respective intersections to perform display control using a liquid crystal by driving the scanning lines and the data lines. The display device further including a row decoder for selecting the scanning lines, a memory cell section having memory cells that are in the number capable of storing an image signal for display control of dots in at least one row of a display drive section and allocated corresponding to the length in the row direction of the display drive section. The display device further having a column decoder section for selecting a memory cell to be stored with an inputted image signal, a column selection switch section switching on the basis of a selection by the column decoder section 51 and the image signal and storing the image signal to the memory cell selected, and a k-bit DAC section 41 for driving a data line on the basis of the image signal stored in the memory cell section.

23 Claims, 11 Drawing Sheets

U.S. PATENT DOCUMENTS

| | | | | |
|---|---|---|---|---|
| 5,815,136 | A * | 9/1998 | Ikeda et al. | 345/98 |
| 5,945,974 | A * | 8/1999 | Sharma et al. | 345/98 |
| 6,025,822 | A * | 2/2000 | Motegi et al. | 345/98 |
| 6,049,321 | A * | 4/2000 | Sasaki | 345/99 |
| 6,111,557 | A * | 8/2000 | Koyama et al. | 345/89 |
| 6,223,265 | B1 * | 4/2001 | Kawasaki et al. | 711/167 |
| 6,339,417 | B1 * | 1/2002 | Quanrud | 345/98 |
| 6,472,684 | B1 * | 10/2002 | Yamazaki et al. | 257/72 |
| 6,873,312 | B2 | 3/2005 | Matsueda | |

FOREIGN PATENT DOCUMENTS

| | | | |
|---|---|---|---|
| EP | 0456394 | A2 | 11/1991 |
| EP | 0488851 | A1 | 6/1992 |
| JP | 63-229430 | A | 9/1988 |
| JP | 5-297345 | A | 11/1993 |
| JP | A-281636 | | 10/1995 |
| JP | 8-166775 | A | 6/1996 |
| JP | 8-227283 | A | 9/1996 |
| JP | A-08-227283 | | 9/1996 |
| JP | 10-222136 | A | 8/1998 |
| JP | 11-65536 | A | 3/1999 |
| JP | A-11-058065 | | 3/1999 |
| JP | 2000-227608 | A | 8/2000 |

* cited by examiner

DISPLAY DEVICE HAVING A DISPLAY DRIVE SECTION

TECHNICAL FIELD

The present invention relates to display devices. More particularly, the invention relates to a drive circuit or the like to make display on a liquid crystal display (LCD: Liquid Crystal Display) or an organic EL display (OELD: Organic Electro Luminescent Display).

BACKGROUND OF THE INVENTION

Recently, display devices using liquid crystal (hereinafter, referred to as display) are spreading at conspicuous pace. The display of this type is low in power consumption and improved in saving space in comparison with a CRT display. Accordingly, it is important to make use of the merits of such a display and produce a display that is lower in power consumption and improved in saving space.

FIG. 11 is a block diagram of a system to implement display through a display device with a TFT display. This system is constituted with an image signal source 100 and a TFT liquid crystal display panel 101. The image signal source 100 is formed, at least, by a CPU 100A, a RAM 100B, a frame memory 100C and an LCD controller 100D. The CPU 100A is operation control means to transmit display data while exchanging data with the RAM 100B as a general-purpose memory. This memory RAM 100B is not especially provided only as a display memory, and hence requires newly a memory to store data for display. It is the frame memory 100C. The frame memory 100C. temporarily stores display data for one screen of a liquid crystal panel 101C (hereinafter, the data for one pixel is given as display data, and each binary signal forming the display data is referred to as an image signal). The LCD controller 100D is to implement transmission control or the like of display data, in order to display in timing the display data stored in the frame memory 100C in display positions on the liquid crystal panel 101C. Herein, although for the CRT there is a need to transmit the display data through conversion into analog data, the display data herein is transmitted by an image signal as digital data on the assumption that the interface of the liquid crystal display corresponds to digital data. If the image signal is digital data, D/A conversion is not required on the side of the TFT liquid crystal display panel 101.

Meanwhile, the TFT liquid crystal display panel 101 is structured with a scanning line driver 101A, a digital data driver 101B and a liquid crystal panel 101C. The scanning line driver 101A controls display in a scanning line (row) direction on the basis of timing data transmitted from the LCD controller 100D. The digital data driver 101B can receive and process digital-data image signal. The digital data driver 101B controls display in a data-line (column) direction on the basis of timing data transmitted from the LCD controller 100D. Thereupon, display tonal level is also controlled. The liquid crystal panel 100C is a panel having TFTs (Thin Film Transistors) to make display under the control of the scanning line driver 01A and digital data driver 101B.

In such a system, the LCD controller 100D must transmit to the digital data driver 101B the display-data image signal for the entire screen temporarily stored in the frame memory 100C. Moreover, transmission timing by progressive scanning is fixed. Consequently, there is a need to transmit image signals in timing also for the display data on the pixels not requiring display change. Due to this, there is an increase in useless data transmission amount and hence increase in power consumption. Thus, reduction of power consumption cannot be achieved.

Therefore, it is an object of the present invention to obtain a display device of a space-saved design having a structure for achieving consumption-power reduction and moreover taking into consideration layout efficiency particularly for the case of integrally forming the peripheral circuit over a glass substrate.

DISCLOSURE OF THE INVENTION

A display device of the invention of claim 1 comprises: a display drive section having a plurality of scanning lines and a plurality of data lines formed in a grating form corresponding to dots as minimum units of display and active elements provided corresponding to intersections, to perform display control using a liquid crystal by driving the scanning lines and the data lines; a scanning line driver section allocated corresponding to a length in a column direction of the display drive section, to select and drive the scanning lines; a memory cell section having memory cells that are in the number capable of storing an image signal for performing display control of dots in at least one row of the display drive section and allocated corresponding to the length in the row direction of the display drive section; a column decoder section allocated corresponding to the length in the row direction of the display drive section, to select the memory cells for storing an input image signal; a column selection switch section allocated corresponding to the length in the row direction of the display drive section to switch on the basis of a selection by the column decoder section and the image signal and storing the image signal to the memory cells selected by the column decoder section; and a data line driver section allocated corresponding to the length in the row direction of the display drive section to drive the data lines on the basis of the image signal stored in the memory cell section, integrated on a semiconductor or an insulating substrate and integrally formed therewith.

In this invention, where integral formation is made using polysilicon TFTs including a peripheral circuit on an insulating substrate, for example, of a glass substrate, or a quartz substrate, memory cells of the memory cell section are allocated in the number capable of storing an image signal for display control of at least the dots on one row of the display drive section corresponding to a length in a row direction of the display drive section in order to achieve space saving, besides the column decoder section, column select switch section and data line driver section.

It is noted that the points "allocated corresponding to a length in a column direction" and "allocated corresponding to a row direction" mean that, for example, in the memory cell section, the length in the row direction thereof corresponds to a length in the row direction of the display drive section. More specifically, this means "the length in the row direction is equal to or smaller than the length in the row direction of the display drive section", as limited in the invention of claim 2. The meaning of "equal to or smaller than" is either that the both are equal or that the former is small as compared to the latter. In the invention, however, for example the length in the row direction of the memory cell section may be satisfactorily somewhat greater (e.g. about several %) than the length in the row direction of the display drive section.

In brief, for the memory cell section, for example, it is satisfactory, where integrating it together with the display drive section on a substrate, to avoid the occurrence of a useless space on the substrate due to non-correspondence of the dimensions of the memory cell section to the dimensions of the display drive section. The occurrence of a useless space is meant, for example, to cause a comparatively broad space that no circuit is provided on the substrate in an area of the display drive section along a row-direction-side end because the length in the row direction of the memory cell section is largely longer than the length in the row direction of the display drive section.

A display device of the invention of claim 2 comprises: a display drive section having a plurality of scanning lines and a plurality of data lines formed in a grating form corresponding to dots as minimum units of display and active elements provided corresponding to intersections, to perform display control using a liquid crystal by driving the scanning lines and the data lines; a scanning line driver section allocated to have a length in a column direction equal to or smaller than a length in a column direction of the display drive section, to select and drive the scanning lines; a memory cell section having memory cells that are in the number capable of storing an image signal for performing display control of dots in at least one row of the display drive section and allocated to have a length in a row direction thereof equal to or smaller than the length in the row direction of the display drive section; a column decoder section allocated to have a length in a row direction equal to or smaller than the length in the row direction of the display drive section, to select the memory cells for storing an input image signal; a column selection switch section allocated to have a length in a row direction equal to or smaller than the length in the row direction of the display drive section, to switch on the basis of a selection by the column decoder section and the image signal and storing the image signal to the memory cells selected by the column decoder section; and a data line driver section allocated to have a length in a row direction equal to or smaller than the length in the row direction of the display drive section, to drive the data lines on the basis of the image signal stored in the memory cell section, integrated on a semiconductor or an insulating substrate and integrally formed therewith.

In this invention, where integral formation is made using polysilicon TFTs including a peripheral circuit on an insulating substrate for example, of a glass substrate, or a quartz substrate, memory cells of the memory cell section are allocated in the number capable of storing an image signal for display control of at least the dots on one row of the display drive section to have a length in the row direction thereof equal to or smaller than the length in the row direction of the display drive section in order to achieve space saving, besides the column decoder section, column selection switch section and data line driver section.

A display device of the invention of claim 3 comprises: a display drive section having a plurality of scanning lines and a plurality of data lines formed in a grating form corresponding to dots as minimum units of display and active elements provided corresponding to intersections, to emit an organic EL element connected to the active elements by driving the scanning lines and the data lines to perform display control; a scanning line driver section allocated corresponding to a length in a column direction of the display drive section, to select and drive the scanning line; a memory cell section having memory cells that are in the number capable of storing an image signal for performing display control of dots in at least one row of the display drive section and allocated corresponding to the length in the row direction of the display drive section; a column decoder section allocated corresponding to the length in the row direction of said display drive section, to select the memory cells for storing an input image signal; a column selection switch section allocated corresponding to the length in the row direction of the display drive section to switch on the basis of a selection by the column decoder section and the image signal and storing the image signal to the memory cells selected by the column decoder section; and a data line driver section allocated corresponding to the length in the row direction of the display drive section, to drive the data lines on the basis of the image signal stored in the memory cell section, integrated on a semiconductor or an insulating substrate and integrally form therewith.

In this invention, where the display drive circuit for display control using an organic EL element including a peripheral circuit is integrally formed, for example, on polysilicon, memory cells of the memory cell section are allocated in the number capable of storing an image signal for display control of at least the dots on one row of the display drive section corresponding to a length in a row direction of the display drive section.

It is noted that the points "allocated corresponding to a length in a column direction" and "allocated corresponding to a row direction" mean that, for example, in the memory cell section, the length in the row direction thereof corresponds to a length in the row direction of the display drive section. More specifically, this means "the length in the row direction is equal to or smaller than the length in the row direction of the display drive section", as limited in the invention of claim 4. The meaning of "equal to or smaller than" is either that the both are equal or that the former is small as compared to the latter. In the invention, however, for example, the length in the row direction of the memory cell section may be satisfactorily somewhat greater (e.g. about several %) than the length in the row direction of the display drive section.

In brief, for the memory cell section, for example, it is satisfactory, where integrating it together with the display drive section on a substrate, to avoid the occurrence of a useless space on the substrate due to non-correspondence of the dimensions of the memory cell section to the dimensions of the display drive section. The occurrence of a useless space is meant, for example, to cause a comparatively 110 broad space that no circuit is provided on the substrate in an area of the display drive section along a row-direction-side end because the length in the row direction of the memory cell section is largely longer than the length in the row direction of the display drive section.

A display device of the invention of claim 4 comprises: a display drive section having a plurality of scanning lines and a plurality of data lines formed in a grating form corresponding to dots as minimum units of display and active elements provided corresponding to intersections, to emit an organic EL element connected to the active elements by driving the scanning lines and the data lines to perform display control; a scanning line driver section allocated to have a length in a column direction equal to or smaller than a length in a row direction of the display drive section, to select and drive the scanning lines; a memory cell section having memory cells that are in the number capable of storing an image signal for performing display control of dots in at least one row of the display drive section and allocated to have a length in a row direction thereof equal to or smaller than the length in the row direction of the display drive section; a column decoder section allocated to have a length in a row direction equal to or smaller than the length in the row direction of the display drive section, to select the memory cells for storing an input image signal; a column selection switch section allocated to have a length in a row direction equal to or smaller than the length in the row direction of the display drive section, to switch on the basis of a selection by the column decoder section and the image signal and storing the image signal to the memory cells selected by the column decoder section; and a data line driver section allocated to have a length in a row direction equal to or smaller than the length in the row direction of the display drive section, to drive the data lines on the basis of the image signal stored in the memory cell section, integrated on a semiconductor or an insulating substrate and integrally formed therewith.

In this invention, where the display drive circuit for display control using an organic EL element including a peripheral circuit is integrally formed, for example, on polysilicon, memory cells of the memory cell section are allocated in the number capable of storing an image signal for display control of at least the dots on one row of the display drive section to have a length in a row direction thereof equal to or smaller than a length in the row direction of the display drive section, in order to achieve space saving, besides the column decoder section, column selection switch section and data line driver section.

A display device of the invention of claim 5 comprises: a display drive section having a plurality of scanning lines and a plurality of bit line, and a liquid crystal controlled in display by driving the corresponding ones of the scanning lines and bit lines and provided on a dot-by-dot basis as minimum units of display control, and formed in a matrix form; a memory cell section having memory cells that are in the number capable of storing an image signal for performing display control of dots in at least one row of the display drive section and allocated corresponding to the length in the row direction of the display drive section; a column decoder section allocated corresponding to the length in the row direction of the display drive section, to select the memory cells for storing an input image signal; and a column selection switch section allocated corresponding to the length in the row direction of the display drive section, to switch on the basis of a selection by the column decoder section and the image signal and storing the image signal to the memory cell selected by the column decoder section, integrated on a semiconductor or an insulating substrate and integrally formed therewith.

In this invention, where the display drive circuit for display control using a liquid crystal including a peripheral circuit is integrally formed by using polysilicon TFTs, memory cells of the memory cell section are allocated in the number capable of storing an image signal for display control of at least the dots on one row of the display drive section corresponding to a length in a row direction of the display drive section in order to achieve space saving, besides the column decoder section and column selection switch section.

It is noted that the point "allocated corresponding to a row direction" means that, for example, in the memory cell section, the length in the row direction thereof corresponds to a length in the row direction of the display drive section. More specifically, this means "the length in the row direction is equal to or smaller than the length in the row direction of the display drive section", as limited in the invention of claim 6. The meaning of "equal to or smaller than" is either that the both are equal or the that former is smaller compared to the latter. In the invention, however, for example, the length in the row direction of the memory cell section may be satisfactorily somewhat greater (e.g. about several %) than the length in the row direction of the display drive section.

In brief, for the memory cell section, for example, it is satisfactory, where integrating it together with the display drive section on a substrate, to avoid the occurrence of a useless space on the substrate due to non-correspondence of the dimensions of the memory cell section to the dimensions of the display drive section. The occurrence of a useless space is meant, for example, to cause a comparatively broad space that no circuit is provided on the substrate in an area of the display drive section along a row-direction-side end because the length in the row direction of the memory cell section is largely longer than the length in the row direction of the display drive section.

A display device of the invention of claim 6 comprise: a display drive section having a plurality of scanning lines and a plurality of bit lines, and a liquid crystal controlled in display by driving the corresponding ones of the scanning lines and bit lines and provided on a dot-by-dot basis as minimum units of display control, and formed in a matrix form; a memory cell section having memory cells that are in the number capable of storing an image signal for performing display control of dots in at least one row of the display drive section and allocated to have a length in a row direction thereof equal to or smaller than the length in the row direction of the display drive section, and each of the memory cells being connected to each of the bit lines; a column decoder section allocated to have a length in a row direction equal to or smaller than the length in the row direction of the display drive section, to select the memory cells for string an input image signal; and a column selection switch section allocated to have a length in a row direction equal to or smaller than the length in the row direction of the display drive section, to switch on the basis of a selection by the column decoder section and the image signal and storing the image signal to the memory cells selected by the column decoder section, integrated on a semiconductor or an insulating substrate and integrally formed therewith.

In this invention, where the display drive circuit for display control using a liquid crystal including a peripheral circuit is integrally formed by using polysilicon TFTs, memory cells of the memory cell section are allocated in the number capable of storing an image signal for display control of at least the dots on one row of the display drive section to have a length in a row direction thereof equal to or smaller than a length in the row direction of the display drive section in order to achieve space saving, besides the column decoder section and column selection switch section.

A display device of the invention of claim 7 comprises: a display drive section having a plurality of scanning lines and a plurality of bit lines, and organic EL elements to be controlled in luminescent display by driving the corresponding ones of the scanning lines and bit lines and provided on a dot-by-dot basis as minimum units of control in display, and formed in a matrix form; a memory cell section having memory cells that are in the number capable of storing an image signal for performing display control of dots in at least one row of the display drive section and allocated corresponding to the length in the row direction of said display drive section, and each memory cell being connected to each of the bit lines; a column decoder section allocated corresponding to the length in the row direction of the display drive section to select the memory cells for storing an input image signal; and a column selection switch section allocated corresponding to the length in the row direction of the display drive section to switch on the basis of a selection by the column decoder section and the image signal and storing the image signal to the memory cell selected by the column decoder section, integrated on a semiconductor or an insulating substrate and integrally formed therewith.

In this invention, where the display drive circuit for display control using an organic EL element including a peripheral circuit is integrally formed by using polysilicon TFTs, memory cells of the memory cell section are allocated in the number capable of storing an image signal for display control of at least the dots on one row of the display drive section corresponding to a length in a row direction of the display drive section in order to achieve space saving, besides the column decoder section and column selection switch section.

It is noted that the point "allocated corresponding to a row direction" means that, for example in the memory cell section, the length in the row direction thereof corresponds to a length in the row direction of the display drive section. More specifically, this means "the length in the row direction is equal to or smaller than the length in the row direction of the display drive section", as limited in the invention of claim 8. The meaning of "equal to or smaller than" is either that the both are equal or that the former is smaller compared to the latter. In the invention, however, for example, the length in the row direction of the memory cell section may satisfactorily somewhat greater (e.g. about several %) than the length in the row direction of the display drive section.

In brief, for the memory cell section for example, it is satisfactory, where integrating it together with the display drive section on a substrate, to avoid the occurrence of a useless space on the substrate due to non-correspondence of the dimensions of the memory cell section to the dimensions of the display drive section. The occurrence of a useless space is meant, for example, to cause a comparatively broad space that no circuit is provided on the substrate in an area of the display drive section along a row-direction-side end because the length in the row direction of the memory cell section is largely longer than the length in the row direction of the display drive section.

A display device of the invention of claim 8 comprises: a display drive section having a plurality of scanning lines and a plurality of bit line, and organic EL elements to be controlled in luminescent display by driving the corresponding ones of the scanning lines and bit lines and provided on a dot-by-dot basis as minimum units of control in display, and formed in a matrix form; a memory cell section having memory cells that are in the number capable of storing an image signal for performing display control of dots in at least one row of the display drive section and allocated to have a length in a row direction thereof equal to or smaller than the length in the row direction of the display drive section, and each of the memory cells being connected to each of the bit lines; a column decoder section allocated to have a length in a row direction equal to or smaller than the length in the row direction of the display drive section, to select the memory cells for storing an input image signal; and a column selection switch section allocated to have a length in a row direction equal to or smaller than the length in the row direction of the display drive section, to switch on the basis of a selection by the column decoder section and the image signal and storing the image signal to the memory cells selected by the column decoder section, integrated on a semiconductor or insulating substrate and integrally formed therewith.

In this invention, where the display drive circuit for display control using an organic EL element is integrally formed including a peripheral circuit, by using polysilicon TFTs, memory cells of the memory cell section in the number capable of storing an image signal for display control of at least the dots on one row of the display drive section are allocated to have a length in a row direction thereof equal to or smaller than a length in the row direction of the display drive section in order to achieve space saving, besides the column decoder section, and column selection switch section.

A display device of the invention of claim 9 structures redundant in the number of the memory cells allocated corresponding to the length in the row direction of the display drive section and in the number capable of storing the image signal for display control of the dots on one row of the display drive section.

In this invention, even if structuring redundantly in the number of the memory cells in the number capable of storing the image signal for display control of the dots on one row of the display drive section, they are allocated on the basis of the length in the row direction of the display drive section (e.g. to have a length in the row direction equal to or smaller than the length in the row direction of the display drive section).

A display device of the invention of claim 10 is that the memory cell section connects the memory cells in the number capable of storing an image signal for display control of the one-row dots to each of the word lines in the number equal to the number of the scanning lines and is structured with a memory array corresponding to dot arrangement of the display drive section, and a word line driver section for selecting and driving the word lines are further integrated on and integrally formed with the substrate.

In this invention, the memory cell section is structured by a memory array corresponding to the dot arrangement of the display drive section to store an image signal required for displaying one screen thereby providing a structure capable of reducing data amount externally exchanged and achieving reduction in power consumption. Also, in order to store due to the array structure, on the substrate is integrated and integrally formed therewith a word line driver section to select and drive the word lines provided equal in the number to the scanning lines.

A display device of the invention of claim 11 is that, on the basis of an address signal representative of a display position and a storage position, the scanning line driver section selects the scanning lines and the word line driver section selects the word lines.

In this invention, a scanning line and a word line can be selected randomly by an address signal to secure the freedom in storage or display with respect to the column direction.

A display device of the invention of claim 12, is that the same address signal is inputted to the scanning line driver section and the word line driver section.

In this invention, in order to simplify the interconnections, the same lines can be shared by the scanning line driver section and the word line driver section. Consequently, the same address signal can be inputted in the same timing.

A display device of the invention of claim 13 is that independent address signals are inputted to the scanning line driver section and the word line driver section.

In this invention, in order to enhance the freedom in storage and display operations, independent address signals are inputted to the scanning line driver section and the word line driver section, e.g. operation timing can be made different.

A display device of the invention of claim 14 is that the scanning line driver section operates to select and drive the scanning lines on the basis of the address signal only when a scanning line driver control signal is inputted, and the word line driver section operates to select and drive the word lines on the basis of the address signal only when a word line driver control signal is inputted.

In this invention, in order to simplify the interconnections while enhancing the freedom of storage and display operations, the scanning line driver section can perform selection and driving operations of a scanning lines on the basis of an address signal only when a scanning line driver control signal is inputted and the word line driver section perform selection and driving operations of a word line on the basis of the address signal only when a word line driver control signal is inputted.

A display device of the invention of claim 15 is that the column decoder section selects the memory cell to store an inputted image signal on the basis of the address signal.

In this invention, the column decoder section can select randomly a memory cell to store an image signal due to the address signal and secure the freedom in storage and display with respect to the row direction.

A display device of the invention of claim 16 is that one pixel comprises three dots provided for developing and displaying red, blue and green as light source colors, the image signal being input on the basis of a unit of one-pixel, and the column decoder section selects the memory cell in an amount of one pixel.

In this invention, where the display device performs color displays, the three dots provided for displaying the colors of red, blue and green as light source colors are taken as one pixel to input an image signal on the basis of a unit of one-pixel as a display change unit. The column decoder section selects memory cells in an amount of the one pixel on the basis of that input.

A display device of the invention of claim 17 is that one pixel comprises three dots provided for developing and displaying red, blue and green as light source colors, the image signal being input on the basis of a unit of a plurality of pixels, and the column decoder section selects the memory cells in an amount of the plurality of pixels.

In this invention, where the display device performs color displays, in order to decrease the drive frequency, the three dots provided for displaying the colors of red, blue and green as light source colors are taken as one pixel to input an image signal on the basis of a unit of a plurality of pixels. The column decoder section selects memory cells in an amount of the plurality of pixels on the basis of that input.

A display device of the invention of claim 18 is that an input interconnection for the image signal to be stored in the memory cell and the column selection switch section are formed on a side opposite to the display drive section sandwiching the memory cell section.

In this invention, crossover of interconnections is decreased to improve reduction in consumption power. Also, in order to prevent noise superposition due to the effect of switching or the like, the image-signal input interconnections and the column selection switch section are formed on a side opposite to the display drive section sandwiching the memory cell section.

A display device of the invention of claim 19 is that the memory cell section is allocated with the memory cell corresponding to the length in the row direction of the display drive section and formed in a multi-stage structure.

In this invention, where the memory cell cannot be allocated corresponding to the length in the row direction of the display drive section by the increase of the memory cell in amount of one dot for example due to increase in the number of tonal levels, the structure and the formation is made by providing multi-stages.

A display device of the invention of claim 20 is that the word lines are provided in the number of integer times the number of the scanning lines, and the memory cell section structured by a memory array connecting, by grouping, the memory cells in the number capable of storing the image signal for display control of the one-row dots of the display drive section to the word lines in the number of the integer times.

In this invention, where the memory cell cannot be allocated corresponding to the length in the row direction of the display drive section, for example, by memory-cell increase for one dot due to the increase of tonal levels, the structure and the formation is made by providing a plurality of rows.

A display device of the invention of claim 21 is that the memory cell section is structured by a memory array having the memory cells that are in the number capable of storing the image signal for display control of a plurality of rows of the dots of the display drive section and allocated corresponding to the length in the row direction of the display drive section.

In this invention, where a plurality of rows of memory cells are allocated corresponding to the length in the row direction of the display drive section, in order to save space, the memory cells in the number capable of storing an image signal for display control of a plurality of rows of dots of the display drive section are structured by a memory array assigned corresponding to the length in the row direction of the display drive section.

A display device of the invention of claim 22 is that the memory cell section is structured by a memory array having the memory cells that are in the number capable of storing the image signal for display control of a plurality of rows of the dots of the display drive section and allocated to have a length in the row direction equal to or smaller than the length in the row direction of the display drive section.

In this invention, where a plurality of rows of memory cells are allocated corresponding to the length in the row direction of the display drive section, in order to save space, the memory cells in the number capable of storing an image signal for display control of a plurality of rows of dots of the display drive section are structured by a memory array assigned to have a length in the row direction thereof equal to or smaller than the length in the row direction of the display drive section.

A display device of the invention of claim 23 further comprises a timing controller section for controlling timing of transmitting the address signal, and a memory controller section for controlling to transmit the image signal, integrated on a semiconductor or an insulating substrate and integrally formed therewith.

In this invention, the peripheral circuits required for controlling display are all integrally formed systematically on the same substrate.

A display device of the invention of claim 24 is that a D/A converter is provided between the display drive section and the memory cell section, thereby converting the image signal comprising a digital signal stored in the memory cell into an analog signal, followed by supplying to the display drive section.

In this invention, in order to display in an analog-compatible display drive section, a D/A converter is provided between the display drive section and the memory cell section. In the D/A converter, the image signal after converting into an analog signal is supplied to the display drive section.

A display device of the invention of claim 25 is that the display drive section and the memory cell section are directly coupled to supply the image signal comprising a digital signal stored in the memory cell section to the display drive section.

In this invention, display is made in the display drive section compatible with digital signals. No D/A converter or the like is provided between the display drive section and the memory cell section. The image signal remained in the digital signal is supplied to the display drive section.

A display device of the invention of claim 26 is that the display drive section performs digital drive through area tonal level, time-division tonal level or a combination thereof.

In this invention, the display drive section compatible with digital signals makes display through area tonal level, time-division tonal level or a combination of the both.

BEST MODE FOR CARRYING OUT THE INVENTION

Embodiment 1

Figure 1:
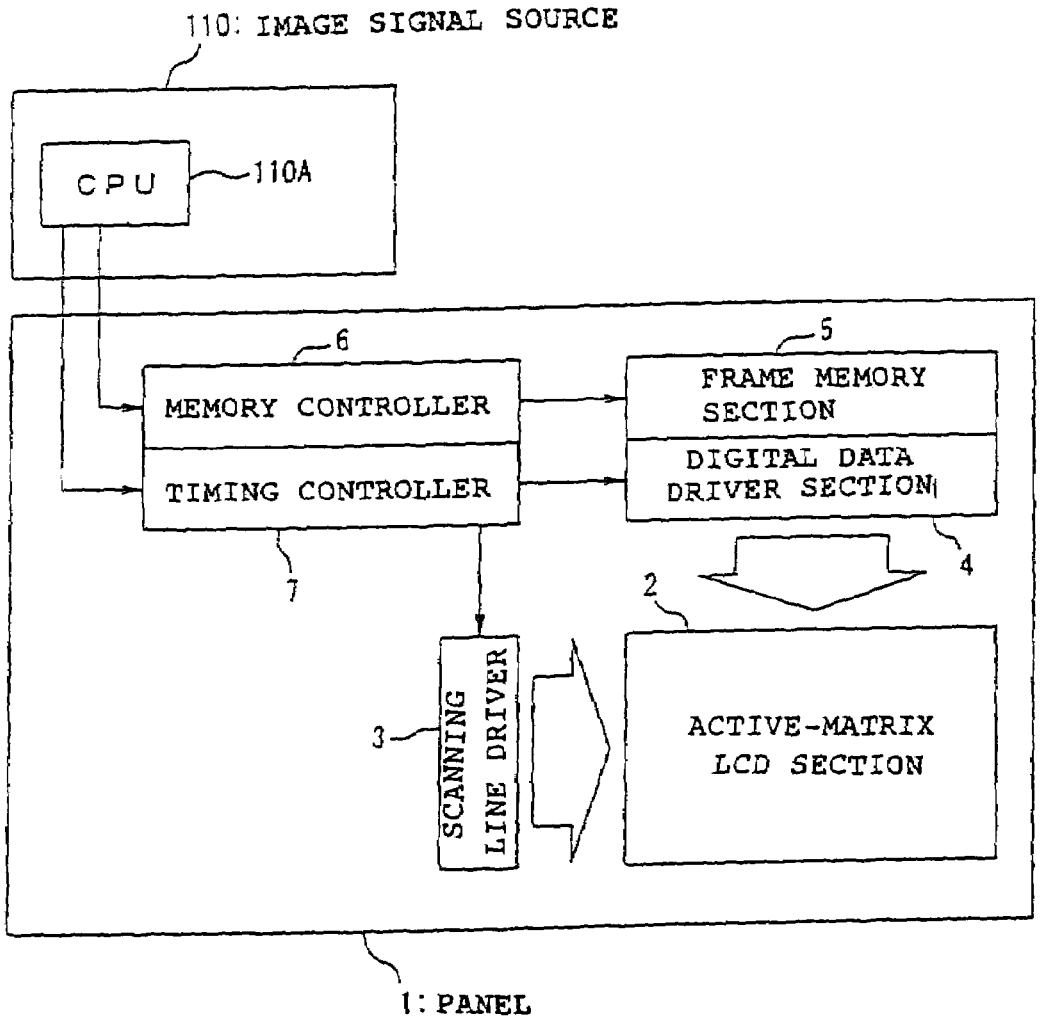
FIG. 1 is a block diagram representing a concept of a system including a display device according to a first embodiment of the present invention.

FIG. 1 is a block diagram showing a concept of a system including a display device according to Embodiment 1 of the present invention. FIG. 1 represents a concept called system-on-panel (SOP). SOP is the concept to form a peripheral circuit for display or the like over a glass substrate, and moreover to integrally form TFTs or the like together with the peripheral circuit by the use of poly-silicon or the like without using chips of ICs or the like. Due to this, the panel can be directly coupled to the CPU while achieving low cost, high reliability and space saving.

Figure 11:
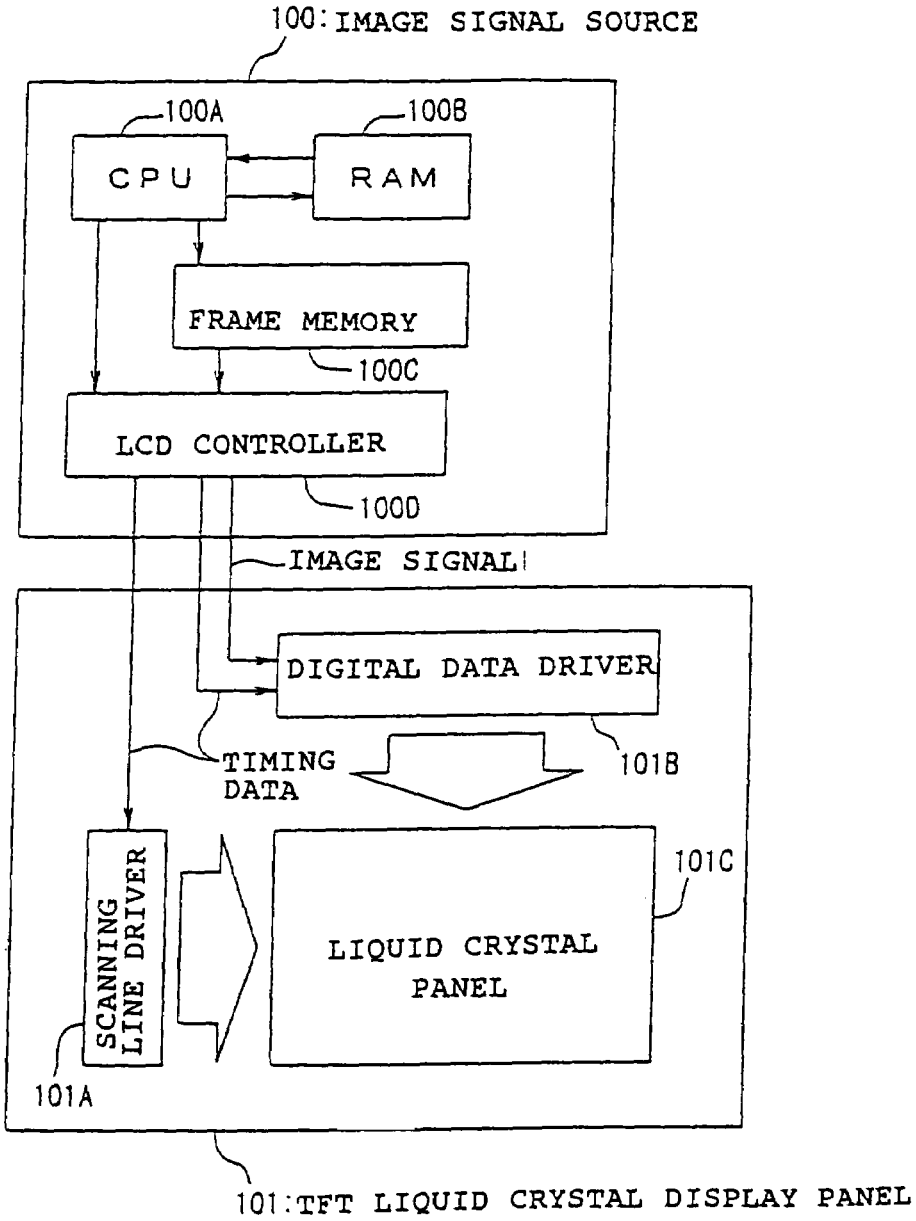
FIG. 11 is a block diagram of a system for display through a display device by a TFT display.

In FIG. 1, an image signal source 110 is configured by a CPU 110A to transmit display data. Herein, the display data is transmitted with image signals as digital data, similarly to the conventional configuration shown in FIG. 11. If the image signal is digital data, D/A conversion is not required on the side of a panel 1, correspondingly achieving the reduction in size and power consumption. Meanwhile, the panel 1 is configured with an active-matrix LCD section 2, a scanning line driver 3, a digital data driver 4, a frame memory section 5, a memory controller 6 and a timing controller 7. The active-matrix LCD section 2 corresponds to a display drive section in the present invention.

Figure 2:
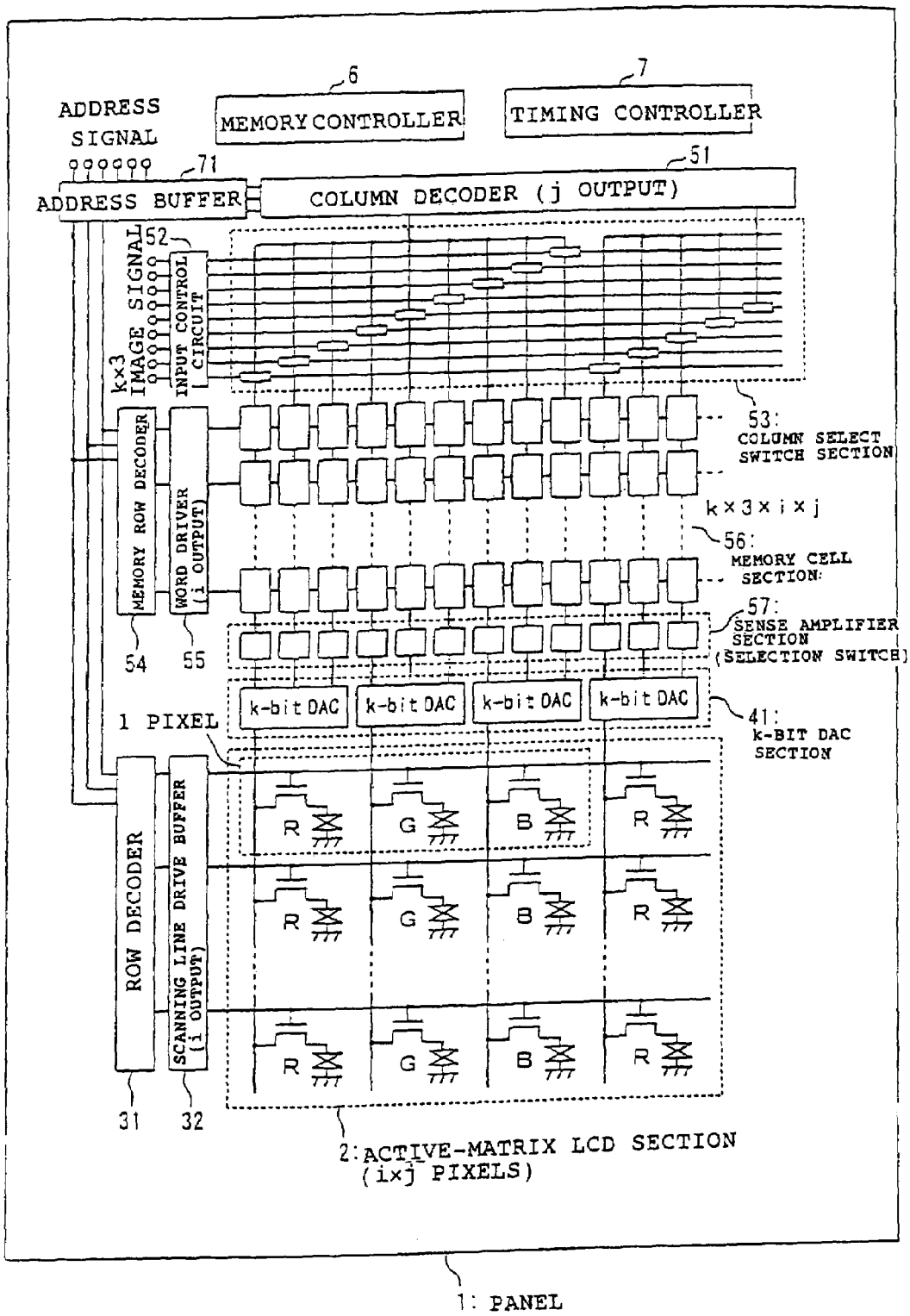
FIG. 2 is a diagram representing in detail a panel 1.

FIG. 2 is a figure representative in detail of the panel 1. The active-matrix LCD section 2 is a part for actual display by use of active elements of TFTs, diodes or the like. The active-matrix LCD section 2 is arrayed with pixels in the number of i×j. Because the present embodiment assumes a color display, three dots (termed also as sub-pixels) of R (Red), G(green) and B(Blue) as light-source colors are constituted as one pixel. For a monochromatic display, the pixel equals to the dot. The dot areas include data lines, scanning lines and active elements (e.g. switching elements by transistors, diodes or the like) arranged corresponding to the intersections of them. The active elements respectively have pixel electrodes to form a capacitance through a liquid crystal to a counter electrode. The voltage applied between the pixel electrode and the counter electrode controls the optical rotatory power due to liquid-crystal molecules, making display control on each dot. Moreover, even if the active element turns off the switch, the pixel electrode can sustain its displaying state owing to the storage charge before refreshing (display data rewriting) in the next time. The switch operation to the active elements and control of the charge supply to the pixel electrodes are implemented by driving a data line and scanning line (supplying current).

It is a scanning line driver 3 that controls to drive a scanning line. The scanning line driver 3 is formed by a row decoder 31 and a scanning line drive buffer 32. The row decoder 31 selects a scanning line to be driven on the basis of address data inputted. The scanning line drive buffer 32 actually drives the scanning line selected by a column decoder 31.

Meanwhile, it is a digital data driver 4 that controls to drive a data line. The digital data driver 4 is formed by a k-bit DAC section 41 as a D/A converter. Herein, a frame memory section 5 will be explained before explaining the operation of the k-bit DAC section 41.

The frame memory section 5 is configured by a column decoder 51, an input control circuit 52, a column selection switch section 53, a memory row decoder 54, a word driver 55, a memory cell section 56 and a sense amplifier section 57. The column decoder 51 selects one pixel out of one row (line) of pixels (in the number of j) on the basis of input address data. This ultimately results in selection of a to-be-driven data line. The input control circuit 52 is a circuit to control an image signal (k×3) in one-pixel amount transmitted in parallel from the memory controller 6. The column selection switch section 53 is provided in the number of pixels on one line (i.e. k×3×j) with reference to one-pixel image signal (k×3) as a unit. Each column selection switch performs switching on the basis of column decoder 51 selection and image signal, driving a bit line. Herein, the input control circuit 52 and column selection switch section 53 is arranged on a side opposite to the active-matrix LCD section 2 while sandwiching the memory cell section 56. This reduces interconnection crossing over, thus achieving simplification and consumption-power reduction. Moreover, by the operation of the input control circuit 52 and column selection switch section 53, no noise will be interposed over the analog-driven LCD 2. Thus, noise reduction in display can be achieved.

The memory row decoder 54 selects a word line on the basis of input address data, in order to store to a desired memory cell of the memory cell section 56 forming the memory array, as described later. The word driver 55 actually drives a word line selected by the memory row decoder 54. Consequently, the image signal is stored as the pixel display data to the memory cells in the number of k×3 that are connected to the word line selected by the memory row decoder 54 and corresponding to the pixels selected by the column decoder 51.

Meanwhile, the memory cell section 56 has memory cells in the number of k×3×i×j to constitute a memory array of i-lines×k×3×j-columns. This number of memory cells is the number required for each dot of R, G or B of the display having a screen of i×j pixels to make display with brightness in a tonal level of 2 k. In FIG. 2, k=3 is given to enable setting with eight tonal-levels of brightness. This number of memory cells is the number of memory cells required, at least, to store an image signal in amount of one screen. For example, in some circuits, a circuit configuration is given with redundant memory cells for the necessity of securing operation stability.

Herein, space saving will be achieved to a greater extent as the size of the glass substrate become equal to the size of the active-matrix LCD section 2 as an actual display part. That is, if the memory cells are arranged such that the length of the memory cell section 56 in the row direction is equal to or smaller than the length of the active-matrix LCD section 2 in the row direction, the memory cells in one column can be arranged most efficiently with a saved space width. Consequently, because the length of memory-cell arrangement in the row direction required to control 1-dot display is equal to or smaller than a pitch of dots, the length of the entire frame memory section 5 in the row direction is given equal to or smaller than the length of the active-matrix LCD section 2 in the row direction. Accordingly, design is made in FIG. 2 such that the length in the row direction of k-bit memory cell arrangement equals to each pitch of dots. Each sense amplifier (or selection switch) of the sense amplifier section 57 and each k-bit DAC of the k-bit DAC section 41 are also designed based upon each pitch of dots.

Also, the number of rows of the memory array is made equal to the number of scanning lines i so that the memory frame section 5 can store display data in amount of 1 screen. Consequently, it is possible to carry out storage with correspondence between a display-positioned pixel and a memory cell provided on a dot-by-dot basis. In order to achieve only space saving, it is satisfactory to have at least one row of memory cells without the especial necessity of constituting a memory array having the number of rows equal to the number of scanning lines. However, in order to reduce the data transmission amount over the system overall and low power consumption, memory cells are required in amount enough to store display data in amount of 1 screen with correspondence. Accordingly, an image signal in amount of display data for a to-be-rewritten pixel is satisfactorily transmitted from the CPU 110A. If no rewriting is made, the digital data driver 4 satisfactorily deals with the image-signal data stored in the memory cell section 56 as it is.

Each sense amplifier constituting the sense amplifier section 57 is connected on column (bit line)-by-column basis. Herein, the use of the sense amplifier is for the case each memory cell of the memory cell section 56 is configured by a dynamic memory. In the case of configuration with a static memory, selection switches are used in configuration instead of sense amplifiers.

The k-bit DAC section 41 constituting the digital data driver 4 is configured by k-bit DACs in the number of 3×j. Each k-bit DAC is inputted with digital data based on the image signal stored on certain memory cells in the number of k through the bit lines in the number of k. The k-bit DAC converts the data-based value into a tonal level, depending upon which tonal level a data line is driven. In the LCD, alternating-current drive is required for the purpose of extending the life of liquid crystal. Accordingly, digital data cannot be used as it is but must be analog-converted. In this manner, display control is made, on the basis of display data, on the dot at an intersection of a driven scanning line and a data line.

Herein, the digital data driver 4 and the frame memory section 5 of the invention are directly coupled (integrated) to drive-operate the data line by the direct use of stored digital data. Accordingly, for convenience (in relation to FIG. 1), the digital data driver 4 is configured by the k-bit DAC section 41, and the frame memory section 5 is configured by the column decoder 51, the input control circuit 52, the column selection switch section 53, the memory row decoder 54, the word driver 55, the memory cell section 56 and the sense amplifier section 57. However, actually such distinction cannot be exactly made if considering the operational relationship between the digital data driver and the frame memory in the conventional use.

The memory controller 6 controls as k×3 image signals in order to store the display data transmitted from the CPU 110A into the frame memory section 5. Also, the timing controller 7 has at least an address buffer 71 and transmit an address signal to the row decoder 31, column decoder 51 and memory row decoder 54 in order to store or display the display data transmitted from the CPU 110A.

In the case of configuring the memory by chips or the like, it is problematic in what way fine provision can be made within the chip and layout be given by taking interconnection, etc into consideration. Where the peripheral circuit such as the memory on a glass substrate, conception differs from that. It is the active-matrix LCD section 2 as an actual display part that occupies over the greatest area on the glass substrate. Moreover, the pitch of pixels (ultimately the entire size) is fixed. Consequently, it is the problem that the system, such as peripheral circuits, is laid out with efficiency in accordance with the size. Although the memory cells can be lessened if considering space saving without considering consumption power, the reduction of consumption power requires memory cells for storing data in amount of one screen. Therefore, the present embodiment aims at presenting the most efficient layout on the basis of establishing a peripheral circuit in order for reducing consumption power.

Next, explanation will be made on the operation of display on the basis of FIG. 2. The CPU 110A transmits display data where to provide change in display. Consequently, where the image does not change, no display data is transmitted. When changing the display, an address signal is transmitted representative of a point (pixel) to be changed in display. Also, a display-data image signal is transmitted. Herein, the frame memory section 5 is provided with word lines corresponding in the number to scanning lines, to enable to store display data (image signal) in amount of one screen corresponding to the respective dots. Moreover, the row decoder 31 and the memory row decoder 54 are provided to enable selection of a scanning line and word line. Accordingly, a scanning line can be selected and driven randomly according to an address signal without requiring sequential scanning, which is convenient for rewriting display data as required. Also, in order to achieve space saving by simplifying the interconnections and reducing the circuit area, the same address signal is inputted to the row decoder 31 and the memory row decoder 54, respectively causing the corresponding sections to store and display in the same timing. As for the column decoder 51, random pixel selection can be made according to an address signal, random writing can be made without the necessity of sequential writing to the pixels (dots) on the same scanning line.

In the case of not providing change in display, the digital data of the image signal stored in the frame memory section 5 is used as it is for making display, wherein no data transmission and reception is made to and from the CPU 1110A. However, because the LCD requires alternating-current drive, there is a need of drive using pixel-inversion drive while refreshing at least at a required minimum frequency. This control is made with the scanning line driver 3 and the digital data driver 4. If the frequency is lowered, consumption-power reduction can be made but flicker occurs due to punch-through voltage or the like. Therefore, in order to make flicker not conspicuous while reducing power consumption, the state of display is maintained with refreshing at a frequency, for example, of 30 Hz for still images (liquid crystal driven at 15 Hz).

As concerned with the frame memory section 5, if the memory cells are constituted by static memories, there is no need to rewrite data (refresh). However, if constituted by dynamic memories, there is a necessity of refreshing in such timing as can hold the storage.

As above, according to the first embodiment, where a system including not only a display part but also peripheral circuit on a substrate as in SOP is integrally formed on a substrate, in the memory cell section 56 of the frame memory section 5, memory cells are formed to be arranged such that the length in the row direction of arrangement of memory cells with an amount required for controlling one-dot display is equal to or smaller than a pitch of dots, i.e., the length in the row direction of the memory cell section 56 is equal to or smaller than the length in the row direction of the active-matrix LCD section 2. Accordingly, it is possible to arrange memory cells in amount of one row with saved space width.

Also, this is similarly made for the sense amplifier section 57 and k-bit DAC section 41, achieving space saving.

Also, the number of rows of the memory array is given the same as the number of scanning lines (i) to enable the frame memory section 5 to store display data (image signal) in amount of one screen. Accordingly, it is possible to store data in amount of one screen with correspondence between the pixel in each position and the memory cell of the memory cell section 56. The image signal only in amount of display data for a to-be-rewritten pixel is satisfactorily transmitted from the CPU 110A. Accordingly, the data transmission amount over the entire system can be decreased, and space-saved forming can be made with the maximum efficiency while achieving the reduction of power consumption.

Also, because the row decoder 31 and the memory row decoder 54 are provided to enable selection of a scanning line and word line to be driven on the basis of an address signal, a scanning line can be selected and driven randomly according to an address signal without the necessity of sequential scanning. This is convenient for rewriting display data as required.

Also, because the same address signal is inputted to the row decoder 31 and the memory row decoder 54 to cause the respective corresponding points to perform storage and display in the same timing, space saving can be made due to simplification of interconnections and reduction of circuit area.

Also, because the row decoder 51 can randomly select a pixel according to an address signal, random writing can be made without the necessity of sequential writing to the pixels (dots) on the same scanning line. This is convenient for rewriting display data as required.

Also, because the input control circuit 52 and the column selection switch section 53 are arranged on a side opposite to the active-matrix LCD section 2 sandwiching the memory cell section 56, crossover of interconnections is decreased thus achieving simplicity and consumption-power reduction. Moreover, there occurs no noise superposition over the analog-driven LCD 2 due to operation of the input control circuit 52 and column selection switch section 53, thus reducing noise in display.

Furthermore, because the memory controller 6 and the timing controller 7 are integrally formed on the panel 1, the panel 1 can be directly coupled to the CPU 110A, thus providing cost reduction, reliability and space saving for the system entirety.

Embodiment 2

Figure 3:
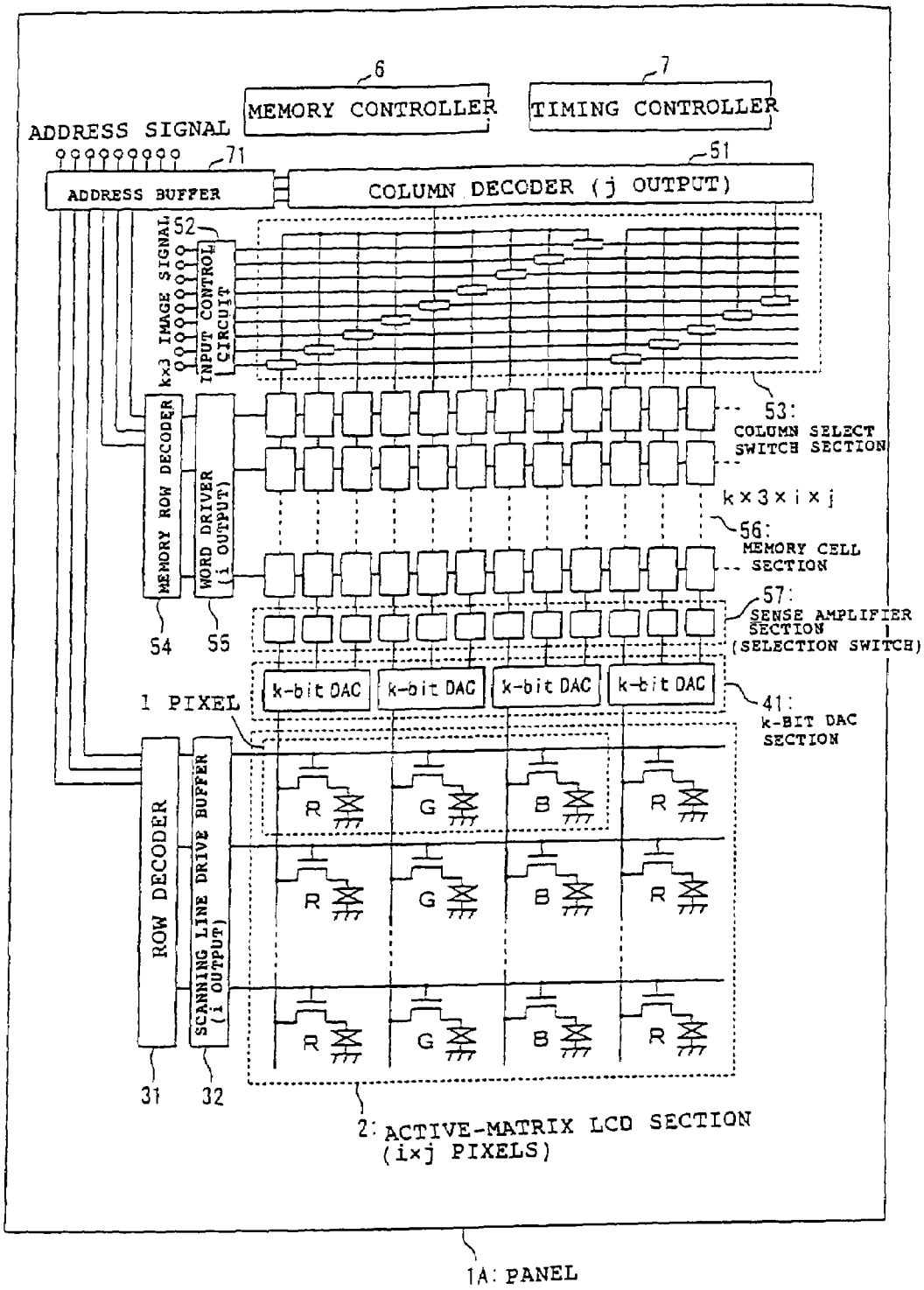
FIG. 3 is a diagram representing in detail a panel 1A according to a second embodiment of the invention.

FIG. 3 is a figure showing in detail a panel 1A according to a second embodiment of the invention. The panel 1A of FIG. 3 differs from the panel 1 of FIG. 2 in that address signals are independently inputted to the row decoder 31 and the memory row decoder 54. Due to this, it is possible to make the timing of storage different from the timing of display operations. The drive frequency is higher than that of storage and display operations in simultaneous timing. However, various forms of driving is feasible, e.g., address data is transmitted to the memory row decoder 54 in certain timing to make storage operation, and then address data is transmitted to the row decoder 31 in the next timing to make display.

As above, according to the second embodiment, because address signals are independently inputted respectively to the row decoder 31 and the memory row decoder 54, it is possible to enhance the freedom for selecting a drive method.

Embodiment 3

Figure 4:
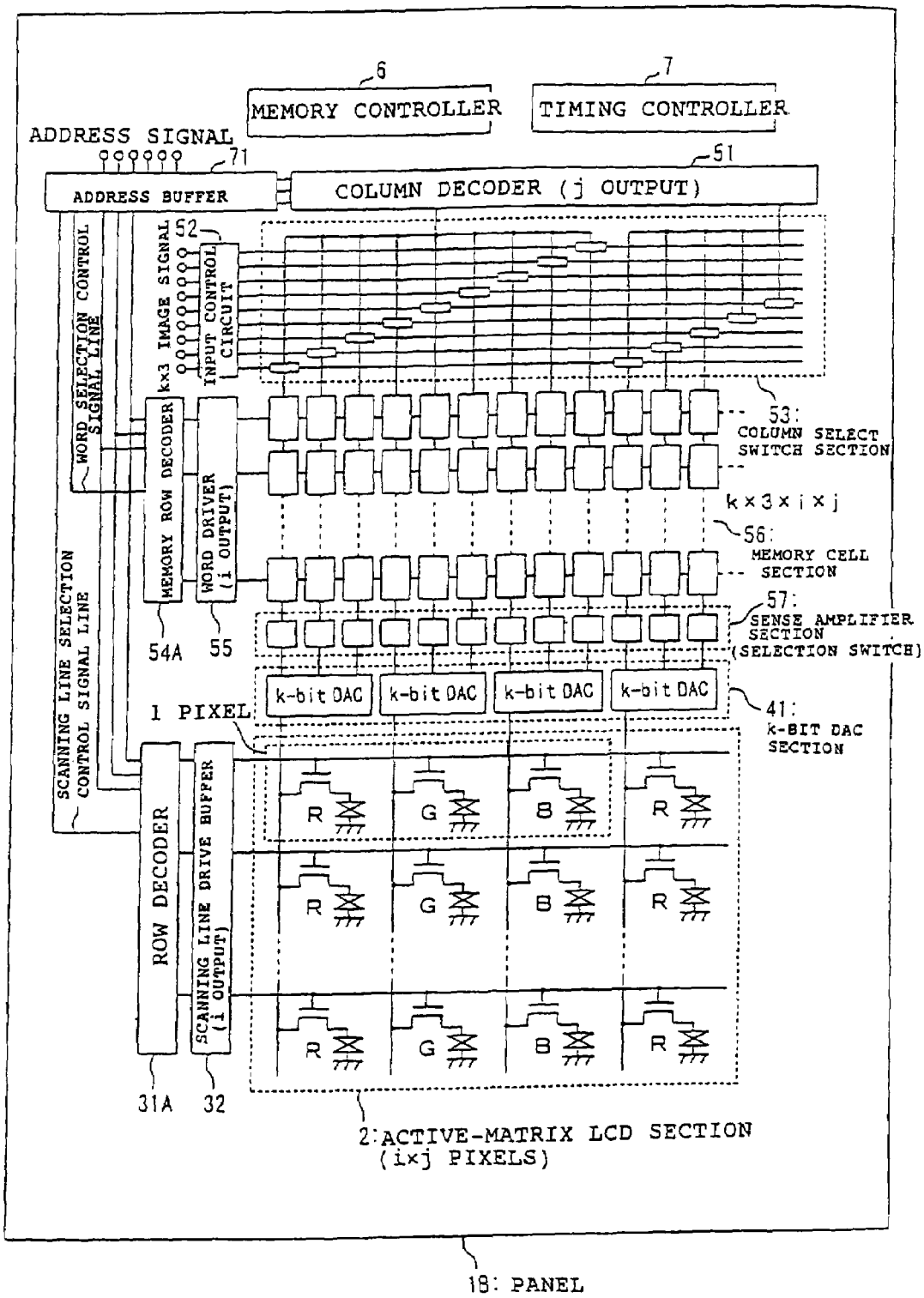
FIG. 4 is a diagram representing in detail a panel 1B according to a third embodiment of the invention.

FIG. 4 is a figure showing in detail a panel 1B according to a third embodiment of the invention. The panel 1B of FIG. 4 differs from the panel 1 of FIG. 2 in that a scanning line-select-control signal line and a word line-select-control signal line are respectively laid from the address buffer 71 to the row decoder 31A and the memory row decoder 54A, to transmit a scanning line-select-control signal and a word-line-select-control signal. The same address signal is inputted to the row decoder 31A and the memory row decoder 54A. However, the row decoder 31A is allowed to select a scanning line only during the period that a scanning line-select-control signal is on. Also, the memory row decoder 54A similarly is allowed to select a word line only during the period that a word-line-select-control signal is on. Consequently, storage and display operations can be made in different timing depending upon control of on-off of these signals.

As above, according to the third embodiment, the scanning line-select period of the row decoder 31A is limited on the basis of the scanning line-select-control signal and the word-line-select period of the memory row decoder 54A is limited on the basis of the word-line-select-control signal.

Therefore, it is possible to enhance the freedom for selecting a drive method for storage and display operations. Accordingly, various ones of drive control are feasible depending on the method.

Embodiment 4

Figure 5:
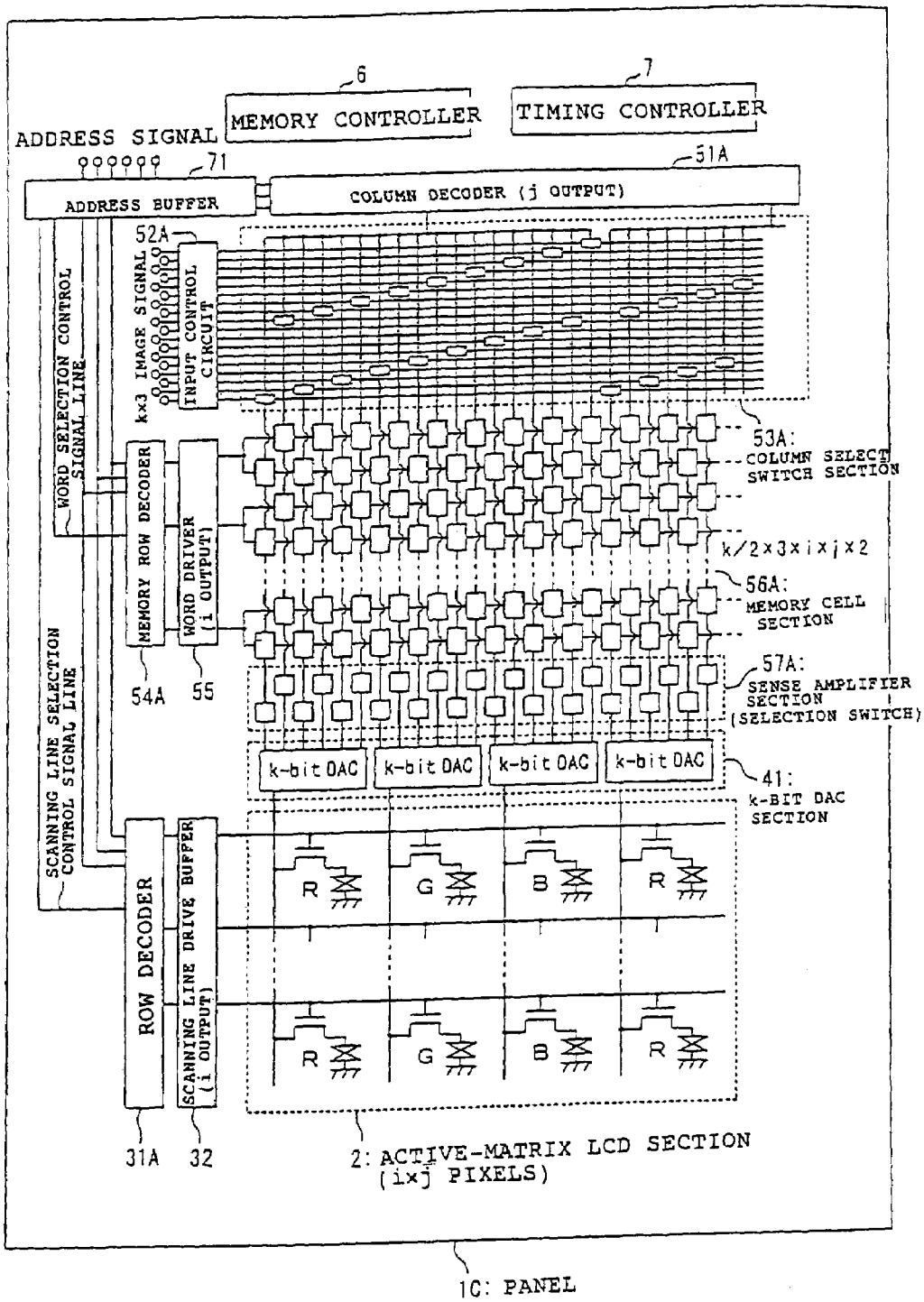
FIG. 5 is a diagram representing in detail a panel 1C according to a fourth embodiment of the invention.

FIG. 5 is a figure representing in detail a panel 1C according to a fourth embodiment of the invention. The panel 1C of FIG. 5 differs from the panel 1B of FIG. 4 in that a column selection switch section 53A, a sense amplifier section 57A and memory cell section 56A are laid out taking into account a case such as k=6. Also, the column decoder 51A and the input control circuit 52A respectively deal with signals in two times due to k=6, as compared to the column decoder 51 and the input control circuit 52 (besides this, different from the panel 1 of FIG. 2 in that there are a scanning line-select-control signal line and a word-line-select-control signal line). As described before, if the memory cells are arranged such that the length in the row direction of the memory cell section 56 is equal to or smaller than the length in the row direction of the active-matrix LCD section 2, then the memory cells in one column can be arranged most efficiently with a saved space width. Accordingly, it is ideal to arrange the memory cells in amount of k bits in the row direction to have a length equal to or smaller than the pitch of dots. However, if increasing the tonal level, the value of k increases (64 tonal levels at k=6, display possible in about 260 thousand colors). That is, there is an increase in the number of memory cells to store 1-dot data. Due to this, it is to be considered that the arrangement of memory cells in amount of k bits as they are will exceeds the pitch of dots. Accordingly, the present embodiment has a memory array in a multi-stage configuration in the memory cell section 56A, wherein the memory cells are laid out and integrally formed to have such an arrangement that the length in the row direction of the memory cell section 56A is equal to or smaller than the length in the row direction of the active-matrix LCD section 2.

Meanwhile, it is to be considered as another way of thinking that the number of memory-array rows is provided integer times the number of scanning lines to constitute a 1-dot memory cells in a plurality of rows. In this case, the k-bit DAC section 41 time-division-processes digital data to drive the data line.

As above, according to the fourth embodiment, where the length of arrangement of k-bit memory cells in the row direction cannot be given equal to or smaller than the pitch of dots, the memory array is made in a multi-stage configuration to have layout and integral formation such that the length in the row direction of the memory cell section 56A equal to or is smaller than the length in the row direction of the active-matrix LCD section 2. Accordingly, it is possible to facilitate interconnections between the memory cell section 56A and the k-bit DAC section 41. Thus, space saving can be achieved.

Embodiment 5

Figure 6:
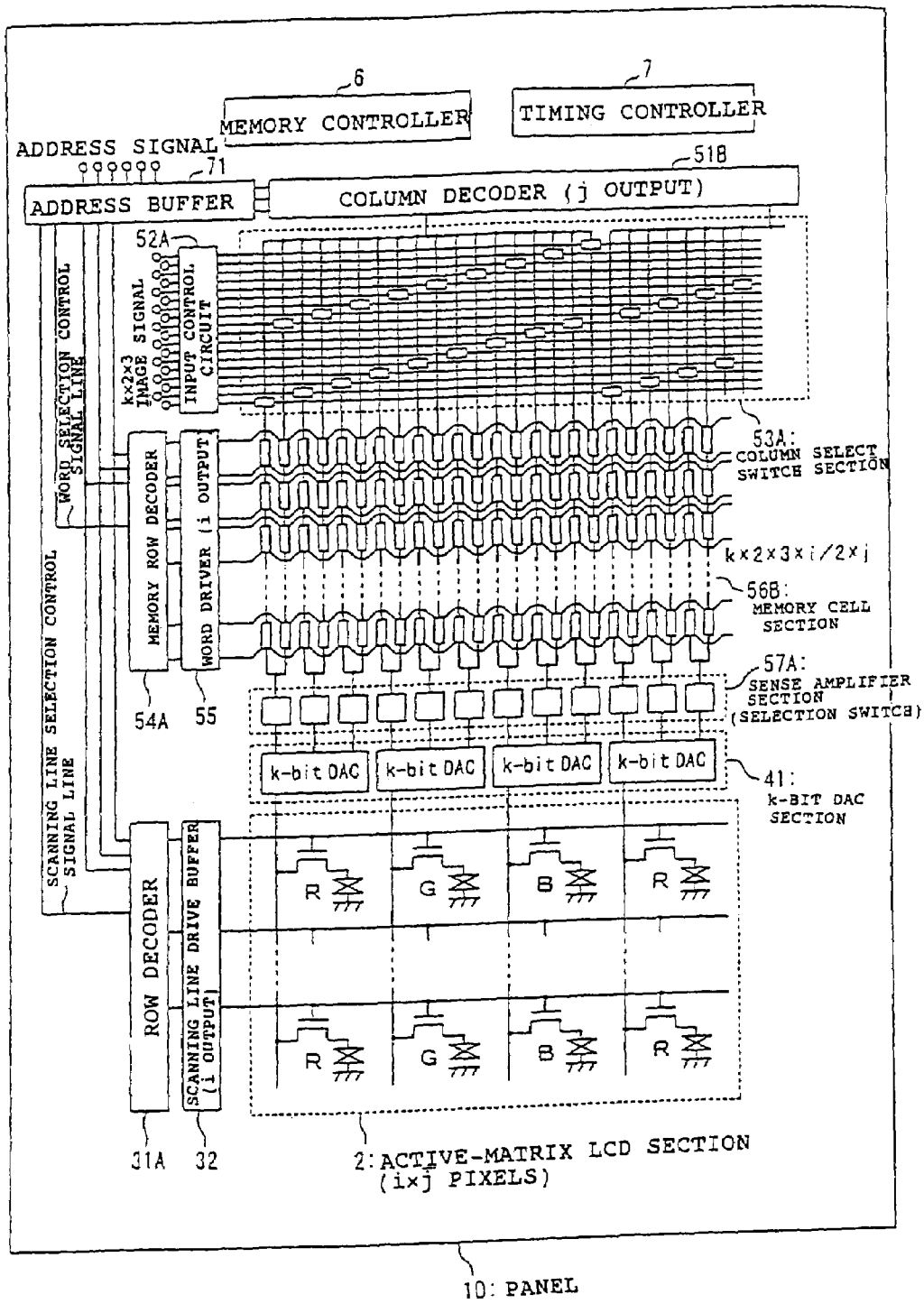
FIG. 6 is a diagram representing in detail a panel 1D according to a fifth embodiment of the invention.

FIG. 6 is a figure representing in detail a panel 1D according to a fifth embodiment of the invention. The panel 1D of FIG. 6 differs from the panel 1B of FIG. 4 in arrangement of memory cells in the memory cell section 56B, and in that the image signals for two pixels are simultaneously inputted so that the column decoder 51B can select two pixels simultaneously. Furthermore, the input control circuit 52A and the column selection switch section 53A respectively deal with signals in two times as compared to the input control circuit 52 and the column selection switch section 53A.

The fourth embodiment explained on the case that the length of arrangement of memory cells in amount of k bits is longer than the pitch of pixels. Conversely, the length of arrangement of memory cells in amount of plurality of pixels (dots) is equal to or smaller than the pitch of one pixel (dot), it is possible to further save the space by laying out and integrally forming the memory cells in amount of a plurality of pixels (dots) arranged corresponding to the one-pixel (dot) pitch. However, in this case, the same number of word lines as the scanning lines are provided to provide memory cells corresponding to the dots without sharing the word lines. It is noted that in this case the sense amplifier section 57 can be shared.

Also, in the first to fourth embodiments the row decoder 51 was configured to select one pixel, as in FIG. 2 to FIG. 5. However, the present invention is not limited to this but may be made to select integer-times simultaneously. In this case, the image signal is inputted in proportion to the multiple.

As above, according to the fifth embodiment, where the length of arrangement with memory cells in amount of plurality of pixels (dots) is equal to or smaller than the length of one-pixel (dot) pitch, the memory cells in amount of plurality of pixels (dots) are laid out and integrally formed by arrangement corresponding to the one-pixel pitch. Accordingly, space saving can be further achieved. Moreover, the sense amplifier section 57 can be shared. Also, because the column decoder 511 can select two pixels simultaneously, the drive frequency can be lowered and power-consumption reduction be achieved despite interconnection is complicate. Also, sufficient operation is obtained even if driven by the active elements inferior in characteristic to the single-crystal FETs.

Embodiment 6

Figure 7:
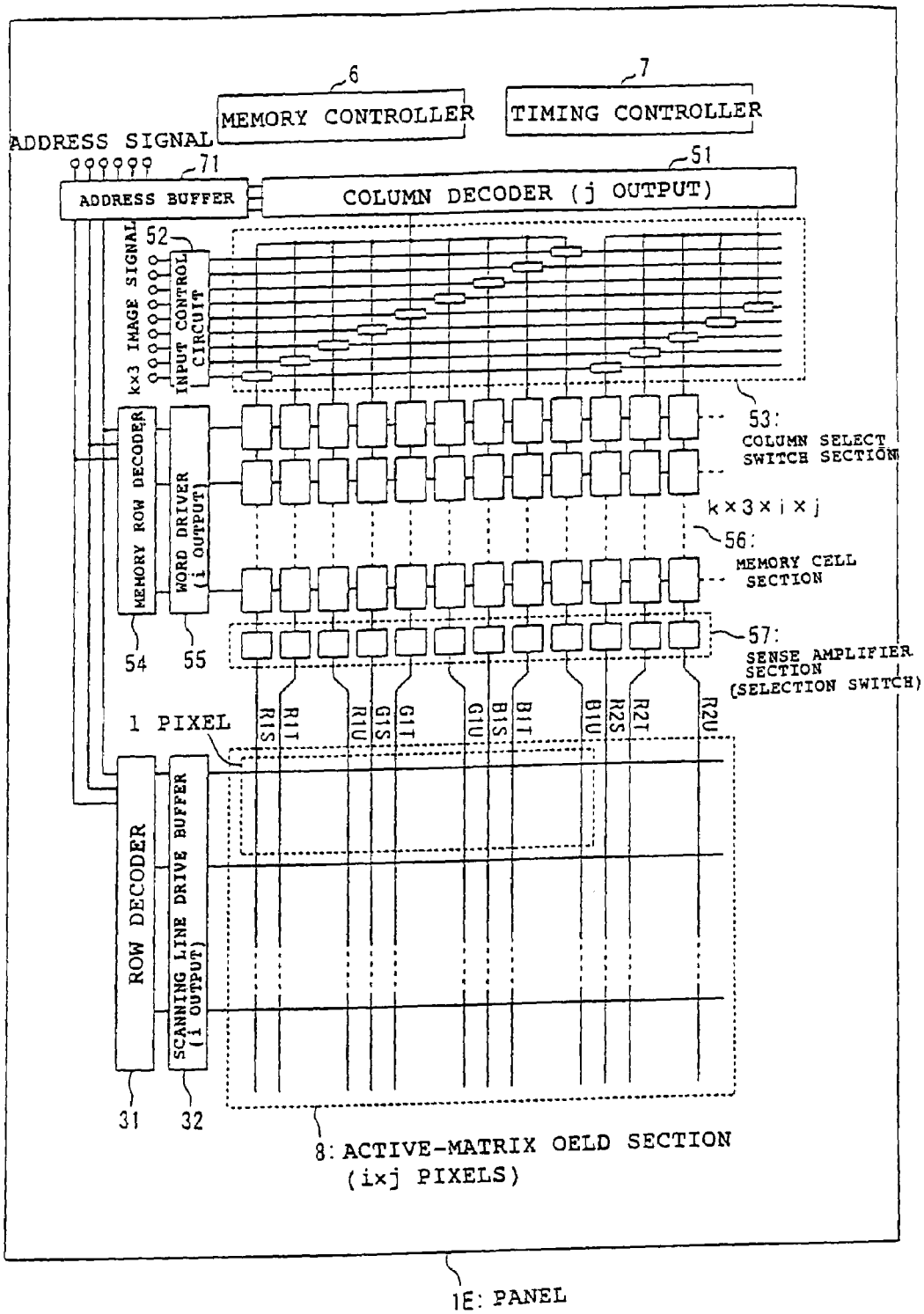
FIG. 7 is a diagram representing in detail a panel 1E according to a sixth embodiment of the invention.

FIG. 7 is a figure representing in detail a panel 1E according to a sixth embodiment of the invention. The panel 1E of FIG. 7 differs from the panel 1 of FIG. 2 in that the section for actual display is made as a digital-compatible active-matrix OEL section 8 as a display drive section and in that the k-bit DAC section 41 is not used.

OEL (organic Electro Luminescent) means an organic EL element. This OEL element is a spontaneous luminescent device different from liquid crystal. Consequently, the device has the following features and is expected in the display field and other fields.

Figure 8:
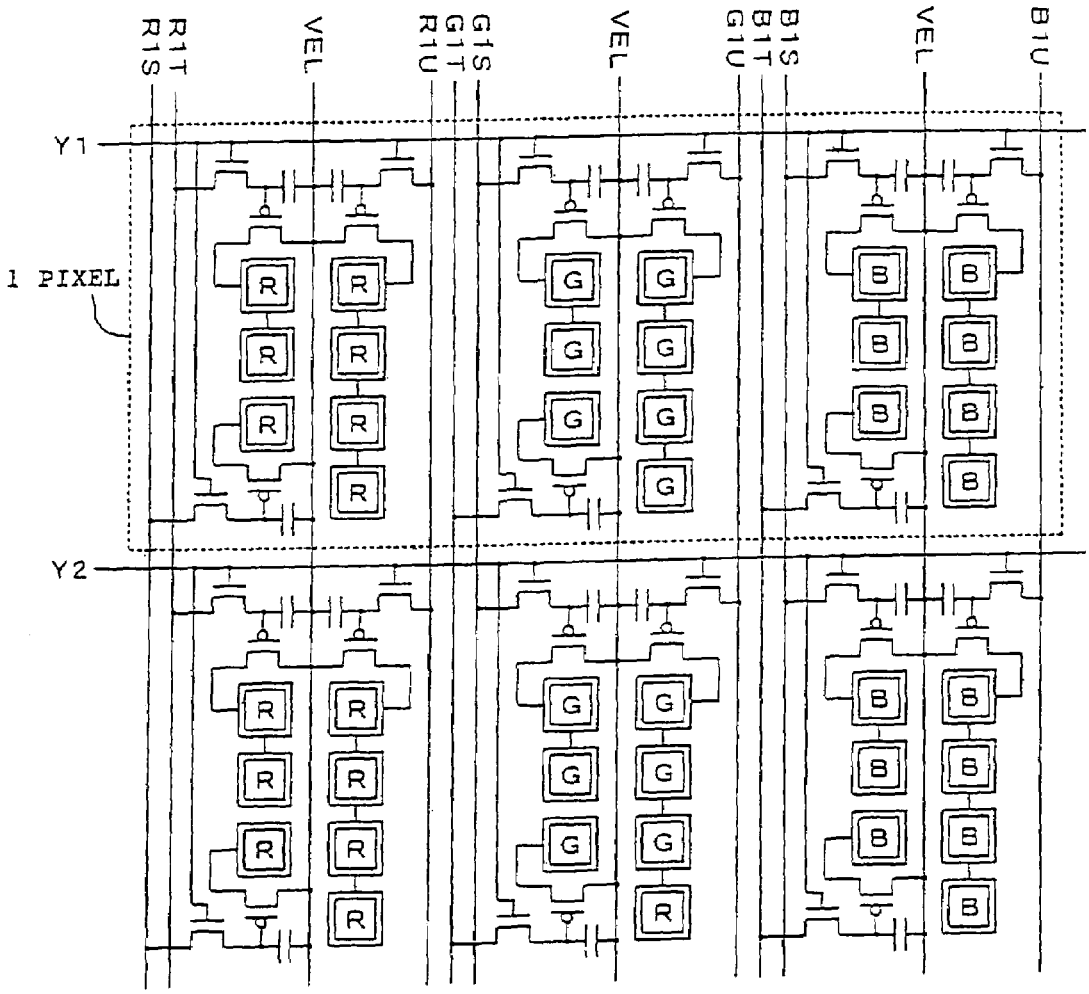
FIG. 8 is a diagram showing a circuit arrangement of an active-matrix OEL section 8.

(1) wide view angle
(2) reduction of weight and thickness feasible
(3) high contrast ratio
(4) low power consumption (back light not required)
(5) multi-color feasible due to molecular design
(6) high-definition display feasible owing to current drive FIG. 8 is a figure showing a circuit arrangement of an active-matrix OEL section 8. FIG. 8 shows an arrangement with two pixels. As described before, LCD requires alternating-current drive for the purpose of extending the life of liquid crystal. Consequently, analog conversion is generally implemented without using digital data as it is. Where making OEL luminous, usually digital data is analog-converted, e.g. two transistor scheme is used to hold the converted analog signal (data) on a capacitance or the like. The output current of the transistor is controlled with the converted analog data to control the luminescence of OEL.

It is noted that OEL is driven on direct current (DC drive). On the other hand, as shown in FIG. 8, it is possible to deal with digital data such as an image signal, as it is, stored on each memory.

Next, explanation will be made on a method for displaying display data stored on the frame memory by exemplifying the dot of R1 (R of a pixel on the first column). R1 is provided with seven OEL elements to display eight tone levels. The seven OEL elements are grouped with one OEL element, two OEL elements and four OEL elements respectively, connected to R1S, R1T and R1U corresponding to each bit line. The difference in tonal level is expressed by luminescent area. Accordingly, at tonal level 0, R1S, R1T and R1U are not driven not to emit any of the elements. At tonal level 1, R1S is driven to make one OEL element luminous. Similarly, at tonal level 2, R1T is driven to make two OEL elements luminous, and at tonal level 3, R1S and R1T are driven to make three OEL elements luminous. Tonal level is represented by the combination of them. This is true for the dots of G and B.

Herein, OEL may be DC driven, and refresh due to inversion drive is usually unnecessary where change in displaying is not required. It is noted that a dynamic circuit is used in FIG. 8. Accordingly, even if there is no change in displaying, there is need to maintain displaying by refreshing at a constant time interval on the basis of the data stored in each memory cell in the frame memory section 5.

Although FIG. 7 describes corresponding to FIG. 2 as the first embodiment, it is needless to say that the active-matrix OEL section 8 is applicable to the display devices employing the respective panels of the second to fifth embodiments.

Also, although the sixth embodiment shows the example to implement digital drive due to so-called area tonal level, it may be, for example, in an arrangement to make digital drive by time-division drive or an arrangement to make digital drive by the combination of area tonal level and time-division drive. In order to provide time-division drive, on-off signals may be applied, in synchronism with a timing signal repeated with a constant period, to the OEL elements in periods different on a bit-by-bit basis corresponding to the digital signal on each bit of each pixel.

As above, according to the sixth embodiment, because OEL element as spontaneous luminescent device is used for display, it is possible not only to obtain the effects of the first to fifth embodiments but also to reduce power consumption and weight due to unnecessity of back light. Moreover, because tonal representation is feasible by using the digital data to be stored in the frame memory section 5, as it is, without analog conversion, there is no need to use such a circuit as DAC. The peripheral circuit can be saved in space and reduced in power consumption.

Embodiment 7

Figure 9:
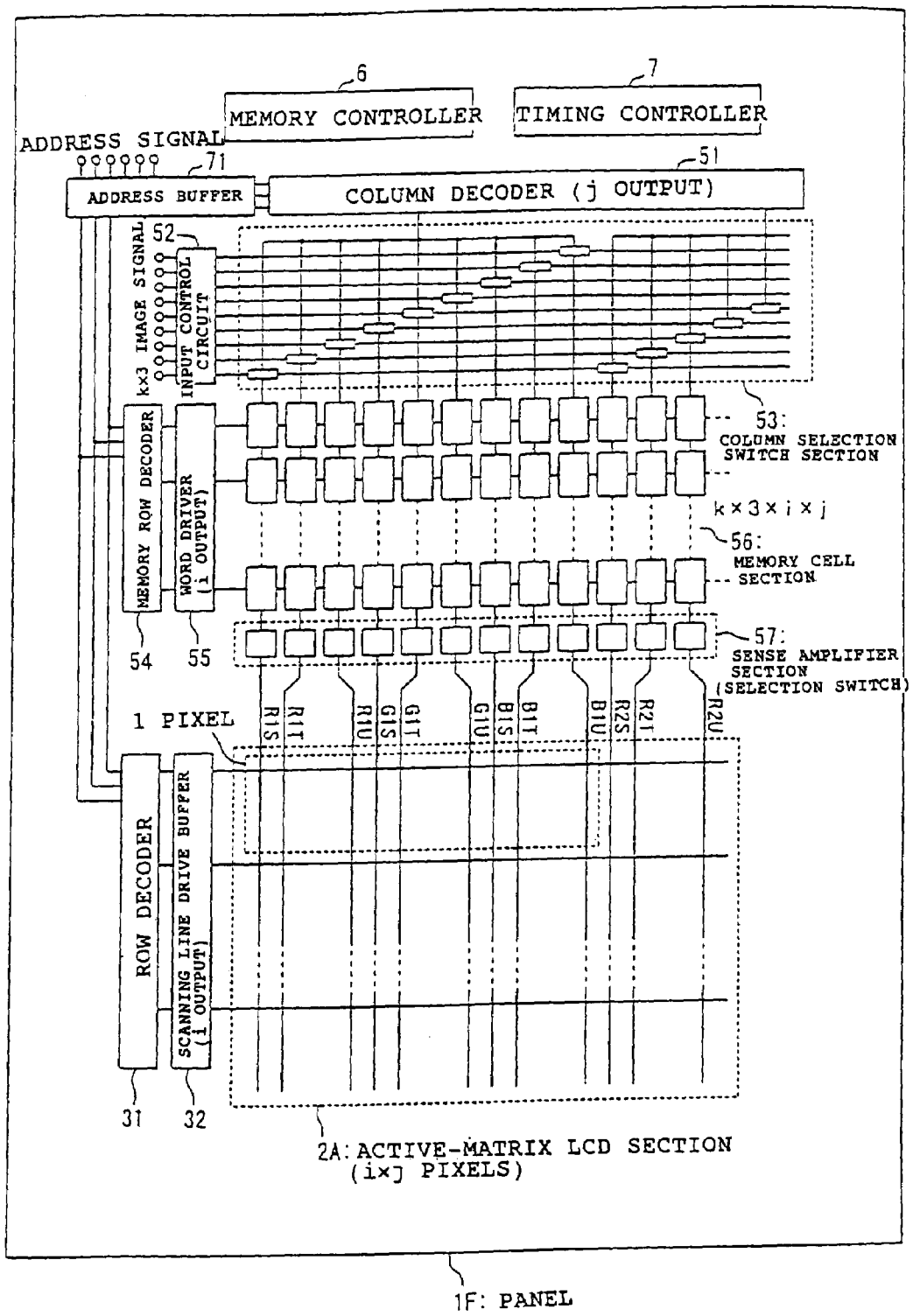
FIG. 9 is a diagram representing in detail a panel 1F according to a seventh embodiment of the invention.

FIG. 9 is a figure representing in detail a panel 1F according to a seventh embodiment of the invention. The panel 1F of FIG. 9 differs from the panel 1E of FIG. 7 in that the section for actual display is made as an active-matrix LCD section 2A as a display drive section.

Incidentally, the panel 1F of FIG. 9 differs from the panel 1 of FIG. 2 in that the section for actual display is made as a digital-compatible active-matrix LCD section 2A and in that the k-bit DAC section 41 is not employed.

Figure 10:
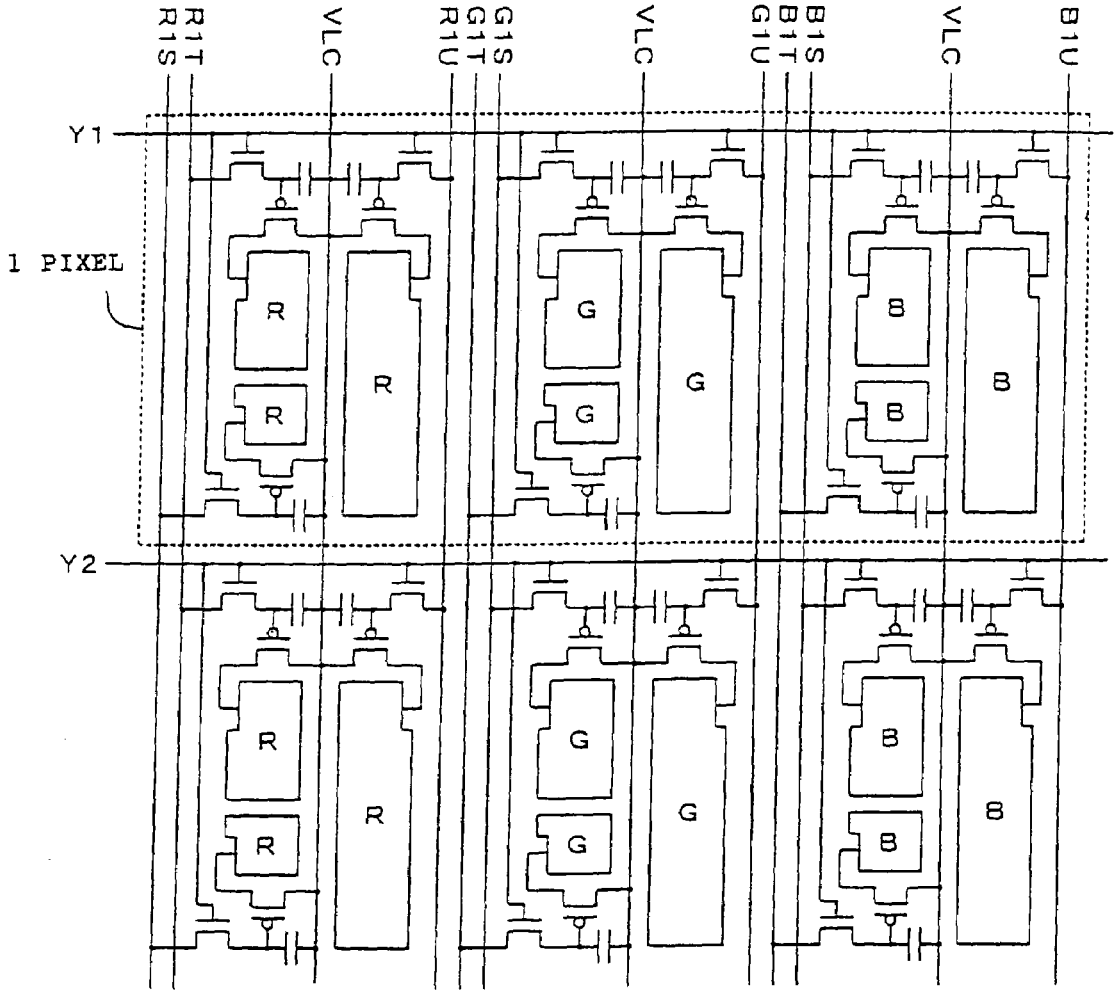
FIG. 10 is a diagram showing a circuit arrangement of an active-matrix LCD section 2A.

FIG. 10 is a figure showing a circuit arrangement of the active-matrix LCD section 2A. FIG. 10 shows an arrangement with two pixels. As described before, because LCD requires alternate-current drive for the purpose of extending the life of liquid crystal, analog conversion is generally made without using digital data as it is. The configuration of FIG. 10 is made to deal with digital data such as the image signal stored on each memory cell, as it is, as hereinafter described.

Next, a method for displaying the display data stored in the frame memory will be explained by exemplifying the dot of RI (R on the first column pixel). RI has three liquid crystal regions respectively covered with independent pixel electrodes in order to represent eight tonal levels. The three liquid crystal regions are in area ratio of 1:2:4 and connected to R1S, R1T and R1U corresponding to each bit line. Meanwhile, the region of the active-matrix LCD section 2A other than the liquid crystal regions, i.e. the entire region excepting the pixel electrodes, are shaded. Accordingly, the difference of tonal level is represented as an area of the liquid crystal region in a transmissive state. Hence, at tonal level 0, R1S, R1T and R1U are not driven to make every liquid crystal region in a shade state. At tonal level 1, R1S is driven to make the liquid crystal region of the area ratio 1 in a transmissive state. Similarly, at tonal level 2, R1T is driven to make the liquid crystal region of the area ratio 2 in a transmissive state, and at tonal level 3, R1S and R1T are driven to make the liquid crystal regions of the area ratio 1 and area ratio 2 in a transmissive state. Tonal level is represented by this combination. This is true for the dots of G and B.

In this embodiment, a rectangular wave is supplied to the common feed line VLC to apply voltage to each liquid crystal region. The voltage of the rectangular wave to be supplied to the common feed line VLC is a voltage that positive and negative potentials can completely raise the liquid crystal. Also, the frequency of the rectangular wave is the same as the frequency of an alternating-current drive in the usual liquid crystal display device. This realizes a digital-compatible active-matrix LCD section 2A.

Incidentally, because FIG. 10 of the present embodiment uses a dynamic circuit similarly to FIG. 8 of the sixth embodiment, there is a need to sustain displaying by refreshing at a constant time interval on the basis of the data stored on each memory cell of the frame memory section 5.

Although FIG. 9 describes corresponding to FIG. 2 as the first embodiment, it is needless to say that the digital-compatible active-matrix LCD section 2A is applicable to the display devices employing the respective panels of the second to fifth embodiments.

Although the seventh embodiment explained the arrangements or the like on the assumption of the transmissive type LCD, the similar idea is applicable even in a reflective type LCD. In a reflective type LCD, because the devices can be arranged at an underside of the pixel electrodes, more complicated circuit will be feasible and advantageous for achieving multi-bit.

Also, although the seventh embodiment shows the example to implement digital drive due to so-called area tonal level, it may be, for example, in an arrangement to make digital drive by time-division drive or an arrangement to make digital drive by the combination of area tonal level and time-division drive. In order to provide time-division drive, on-off signals may be applied, in synchronism with a timing signal repeated with a constant period, to the liquid crystal in periods different on a bit-by-bit basis corresponding to the digital signal on each bit of each pixel.

As above, according to the seventh embodiment, because the digital data to be stored in the frame memory section 5 can be used as it is without analog conversion to provide tonal representation, there is no need to use such a circuit as DAC. The peripheral circuit can be saved in space and reduced in power consumption.

Embodiment 8

Incidentally, although the above embodiments explained on the assumption of the color display, the present invention can cope with a monochromatic display.

INDUSTRIAL APPLICABILITY

As above, according to the inventions of claims 1 and 2, where integral formation is made using TFTs including a peripheral circuit for example on polysilicon, memory cells of the memory cell section in the number capable of storing an image signal for display control of at least the dots on one row of the display drive section were allocated corresponding to a length in the row direction of the display drive section, besides the column decoder section, column selection switch section and data line driver section (e.g. the column decoder section, column selection switch section, data line driver and memory cell section allocated to have a row length smaller than the length in the row direction of the display drive section). Accordingly, the memory cells in one row can be efficiently arranged in a space-saved width.

Also, according to the inventions of claims 3 and 4, where a display drive circuit for display control using, for example, an organic EL element is integrally formed including a peripheral circuit on polysilicon, memory cells in the number capable of storing an image signal for performing display control of dots in at least one row of the display drive section are allocated corresponding to the length in the row direction of the display drive section, besides the column decoder section, column selection switch section and data line driver section (e.g. the column decoder section, column selection switch section, data line driver section and memory cell section are allocated to have a length in the row direction thereof equal to or smaller than the length in the row direction of the display drive section). Accordingly, the memory cells in one row can be efficiently arranged in a space-saved width.

Also, according to the inventions of claims 5 and 6, where a display drive circuit for display control using a liquid crystal is integrally formed including a peripheral circuit, for example, on polysilicon, the memory cells in the number capable of storing an image signal for display control of at least the dots on one row of the display drive section are allocated corresponding the length in the row direction of the display drive section, beside the column decoder section and column section switch section (e.g. the column decoder section, column selection switch section and memory cell section are allocated to have a length in the row direction thereof equal to or smaller than the length in the row direction of the display drive section). Accordingly, the memory cells in one row can be efficiently arranged in a space-saved width. Also, because the organic EL elements are DC-driven, an image signal of a digital signal can be directly used, eliminating the necessity of providing such a circuit as DAC, for example.

Also, according to the inventions of claims 7 and 8, where a display drive circuit for display control using an organic EL element is integrally formed including a peripheral circuit for example on polysilicon, the memory cells of the memory cell section in the number capable of storing an image signal for display control of at least the dots on one row of the display drive section are allocated corresponding to the length in the row direction of the display drive section, besides the column decoder section and column selection switch section (e.g. the column decoder section, column selection switch section and memory cell section are allocated to have a length in the row direction thereof equal to or smaller than the length in the row direction of the display drive section). Accordingly, the memory cells in one row can be efficiently arranged in a space-saved width. Also, the organic EL element is DC-driven, an image signal of a digital signal can be directly used, thus eliminating the necessity of using such a circuit as DAC, for example.

Also, according to the invention of claim 9, even if structuring redundantly in the number of the memory cells in the number capable of storing the image signal for display control of the dots on one row of the display drive section, they are allocated on the basis of the length in the row direction of the display section (e.g. to have a length in the row direction equal to or smaller than the length in the row direction of the display drive section). Accordingly, the space-saved width can be achieved with efficiency.

Also, according to the invention of claim 10, a word line driver section for selecting and driving the word lines provided in the number equal to the scanning lines is further integrated on and formed integrally with the substrate, and the memory cell section is structured by a memory array corresponding to the dot arrangement of the display drive section, to store an image signal required for display over one screen. Accordingly, external exchange of data amount is decreased, achieving reduction in power consumption.

Also, according to the invention of claim 11, the scanning line driver section and word line driver section is made to select a scanning line and word line to be driven on the basis of an address signal. Accordingly, no sequential scanning is required, and random selection and drive of the scanning line can be made in accordance with the address signal. This is convenient in rewriting display data as required.

Also, according to the invention of claim 12, because the same lines are shared in the scanning line driver section and the word line driver section, it is possible to achieve space saving due to simplification of interconnections and reduction in circuit area.

Also, according to the invention of claim 13, because independent address signals are inputted to the scanning line driver section and the word line driver section, it is possible to enhance the freedom in storage and display operations.

Also, according to the invention of claim 14, scanning line driver section operates to select and drive the scanning line on the basis of the address signal only when a scanning line driver control signal is inputted and the word line driver section operates to select and drive the word line on the basis of the address signal only when a word line driver control signal is inputted. Accordingly, it is possible to enhance the freedom in selecting a driving way of storage and display operations. Due to this, a variety of drive control is feasible depending on the method.

Also, according to the invention of claim 15, the column decoder section is made to randomly select a memory cell to store an image signal due to the address signal. Accordingly, there is no need to write sequentially onto the dots on the same scanning line, and random writing can be made. This is convenient in rewriting display data as required.

Also, according to the invention of claim 16, image signals are inputted on one-pixel-unit basis, based on an input of which the column decoder section selects a memory cell in amount of one pixel as a display-change unit thus being convenient.

Also, according to the invention of claim 17, image signals are inputted on a plurality-of-pixel-unit basis, wherein the column decoder section selects a memory cell in amount of a plurality of pixels based on an input thereof. Accordingly, interconnections may be complicated but drive frequency can be decreased thus achieving reduction in power consumption. Also, sufficient operation is available if driving with the active element inferior in characteristic to single crystal FET.

Also, according to the invention of claim 18, the image-signal-input interconnection and column selection switch section are formed on a side opposite to the display drive section sandwiching the memory cell section. Accordingly, it is possible to achieve the reduction in power consumption by decreasing the crossover of interconnections and prevent superposition of noise on the display screen due to the effects of switching or the like.

Also, according to the invention of claim 19, a multi-stage structure is given in the structure and the formation. Accordingly, even where the memory cell cannot be allocated corresponding to the length in the row direction of the display drive section because, for example, of increase in the memory cell in amount of one dot due to increase in the number of tonal levels, the interconnections can be facilitated and space saving be achieved.

Also, according to the invention of claim 20, the structure is made by a plurality of rows. Accordingly, where the memory cell cannot be allocated corresponding to the length in the row direction of the display drive section because, for example, of increase in the memory cell in amount of one dot due to increase in the number of tonal levels, it is possible to suppress the length in the row direction despite the length in the column direction broadens.

Also, according to the inventions of claims 21 and 22, where a plurality of rows of memory cells can be allocated corresponding to the length in the row direction of the display drive section, the memory cells in the number capable of storing an image signal for display control of a plurality of rows of dots of the display drive section are structured by a memory array allocated corresponding to the length in the row direction of the display drive section (e.g. the memory cells allocated to have a length in the row direction equal to or smaller than the length in the row direction of the display drive section). Accordingly, space saving is further achieved.

Also, according to the invention of claim 23, a timing controller section for controlling timing of transmitting the address signal and a memory controller section for controlling to transmit the image signal are further integrated on the substrate and integrally formed therewith, to systematically, integrally forming all the peripheral circuit required for display control on the same substrate. Accordingly, the system entirety can be made at low cost, reliable and space-saved.

Also, according to the invention of claim 24, a D/A converter is provided between the display drive section and the memory cell section to supply the image signal converted into an analog signal to the display drive section. Accordingly, display can be made by the display drive section compatible with analog signals.

Also, according to the inventions of claims 25 and 26, the display drive section and the memory cell section are directly coupled together to directly supply an image signal comprising a digital signal to the display drive section. Accordingly, display can be made by the display drive section compatible with digital signals, and consumption power be reduced.

The invention claimed is:

1. A display device, comprising:

a display section having a plurality of scanning lines, a plurality of data lines and a plurality of dots corresponding to the plurality of scanning lines and the plurality of data lines, each of the plurality of dots including a display element and an active element;

a scanning line driver that drives the plurality of scanning lines;

a data line driver that drives the plurality of data lines;

a memory cell section having a plurality of memory cell groups that include the plurality of memory cells being arranged in a matrix having a plurality of rows and a plurality of columns; and a selection switch section that controls transmission of an image signal to the plurality of memory cell groups, each of the plurality of memory cell groups including memory cells, the memory cell section being disposed between the display section and the selection switch section, the display section, the memory cell section, and the selection switch section being formed on one substrate, each of the plurality of memory cell groups storing first image signals supplied through the selection switch section, and second image signals that are generated by digital to analog conversions of the first image signals stored in each of the plurality of memory cell groups being supplied to one data line of the plurality of data lines.

2. The display device according to claim 1, the memory cell section storing image signals for one screen.

3. The display device according to claim 1, further comprising:

a plurality of word lines among which a word line is selected when a memory cell of the plurality of memory cells receives the first image signals, the plurality of word lines extending along a row direction that intersects a column direction along which the plurality of data lines extend.

4. The display device according to claim 1, the number of the plurality of rows being equal to the number of the plurality of scanning lines.

5. The display device according to claim 1, further comprising a word line driver that drives the plurality of word lines.

6. The display device according to claim 5, the word line driver receiving an address signal that is received by the scanning line driver.

7. The display device according to claim 5, further comprising a column decoder that selects a memory cell of the plurality of memory cells by cooperation with the word line.

8. The display device according to claim 1, further comprising:

a DAC section having a plurality of DACs, each of the plurality of DACs receiving digital data based on the first image signals, each of the plurality of DACs converting the digital data into analog data.

9. The display device according to claim 1, each of the plurality of memory cells of the memory cell section being configured by any one of a dynamic memory and a static memory.

10. The display device according to claim 1, each of the memory cell of the memory cell section rewriting data based on the first image signals without refreshing.

11. The display device according to claim 1, only when a change of display in one dot of the plurality of dots is carried out, a memory cell of the plurality of memory cells that corresponds to the one dot receiving the first image signals.

12. The display device according to claim 1, the memory cell section acting as a frame memory.

13. The display device according to claim 1, a length of the memory cell section in a row direction that intersects a column direction along which the plurality of data lines extend being shorter than a length of the display section.

14. The display device according to claim 1, the number of the plurality of rows of the memory cell section being equal to the number of the plurality of scanning lines.

15. The display device according to claim 1, a gray-scale level in the display section being obtained by at least one of an area gray-scale method, time-division gray-scale method and a method combining the area gray-scale method and the time-division gray-scale method.

16. The display device according to claim 1, further comprising:

a DAC section that includes a plurality of DAC units, each of the plurality of DAC units receiving the first image signals.

17. The display device according to claim 16, the number of the plurality of rows of the memory cell section being more than two.

18. The display device according to claim 16, each of the plurality of DAC units being coupled to one data line of the plurality of data lines.

19. The display device according to claim 1, further comprising:

a sense amplifier section.

20. The display device according to claim 19, further comprising:

a DAC section that includes a plurality of DAC units, the DAC section being disposed between the sense amplifier section and the display section.

21. The display device according to claim 1, the memory cell section further including a memory row decoder for operating the plurality of memory cells, the memory row decoder and the scanning line driver receiving a common controlling signal.

22. The display device according to claim 1, the substrate being a glass substrate.

23. The display device according to claim 1, each of the plurality of memory cells being formed of TFT.

* * * * *